US006764152B2

(12) United States Patent
Umeda et al.

(10) Patent No.: US 6,764,152 B2
(45) Date of Patent: Jul. 20, 2004

(54) LIQUID JETTING APPARATUS AND METHOD FOR DRIVING THE SAME

(75) Inventors: Atsushi Umeda, Nagano (JP); Takakazu Fukano, Nagano (JP); Hideyuki Isamoto, Nagano (JP); Seiji Takamatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/092,949

(22) Filed: Mar. 8, 2002

(65) Prior Publication Data

US 2002/0145637 A1 Oct. 10, 2002

(30) Foreign Application Priority Data

| | | |
|---|---|---|
| Mar. 9, 2001 | (JP) | P2001-067888 |
| Mar. 22, 2001 | (JP) | P2001-082263 |
| Mar. 23, 2001 | (JP) | P2001-084626 |
| Mar. 23, 2001 | (JP) | P2001-086475 |
| Aug. 31, 2001 | (JP) | P2001-265138 |

(51) Int. Cl.[7] ..... B41J 29/38

(52) U.S. Cl. ..... 347/9; 347/10; 347/11; 347/68; 347/5

(58) Field of Search ..... 347/68, 5, 69, 347/75, 10, 11, 12

(56) References Cited

U.S. PATENT DOCUMENTS

| | | | | |
|---|---|---|---|---|
| 4,126,867 A | * | 11/1978 | Stevenson, Jr. | 346/140 |
| 4,284,996 A | * | 8/1981 | Greve | 346/140 |
| 4,459,599 A | | 7/1984 | Ort | |
| 4,679,053 A | * | 7/1987 | Katsurai et al. | 346/1.1 |
| 4,684,957 A | | 8/1987 | Miura et al. | |
| 5,818,473 A | | 10/1998 | Fujii et al. | |
| 6,106,091 A | * | 8/2000 | Osawa et al. | 347/9 |
| 6,174,038 B1 | * | 1/2001 | Nakazawa et al. | 347/10 |
| 6,312,077 B1 | * | 11/2001 | Araki | 347/11 |
| 6,540,313 B2 | * | 4/2003 | Suzuki | 347/5 |

FOREIGN PATENT DOCUMENTS

| | | | |
|---|---|---|---|
| JP | WO 97/32728 | * | 9/1997 |
| JP | 3097155 | | 8/2000 |

* cited by examiner

*Primary Examiner*—Hai Pham
*Assistant Examiner*—Lam S Nguyen
(74) *Attorney, Agent, or Firm*—Sughrue Mion, PLLC

(57) ABSTRACT

In an ink jet printer, a print head is provided with a plurality of nozzles. Each of piezoelectric elements is associated with one of the nozzles, and is provided with a drive electrode and a common electrode. A head driver generates a drive signal for driving the piezoelectric elements, and selectively supplies the drive signal to at least one of the piezoelectric elements to eject an ink droplet from at least one associated nozzle. A bias power source applies a bias voltage having a predetermined potential to the common electrode of each piezoelectric element.

29 Claims, 15 Drawing Sheets

CARRIAGE MECHANISM
12
PAPER FEEDING MECHANISM
11
2
OSCILLATOR
7
ROM
5
RAM
4
OUTPUT BUFFER
4C
WORK MEMORY
4B
RECEPTION BUFFER
4A
I/F
3
CLK
I/F
9
CLK
LAT
SI
CURRENT AMPLIFIER
113
BIAS POWER SOURCE
120
DRIVE WAVEFORM GENERATOR
80
CONTROLLER
6
10
COM
18
114a
114
114a
LEVEL SHIFTER
15
LATCHER
14
SHIFT REGISTER
13
111

FIG.12
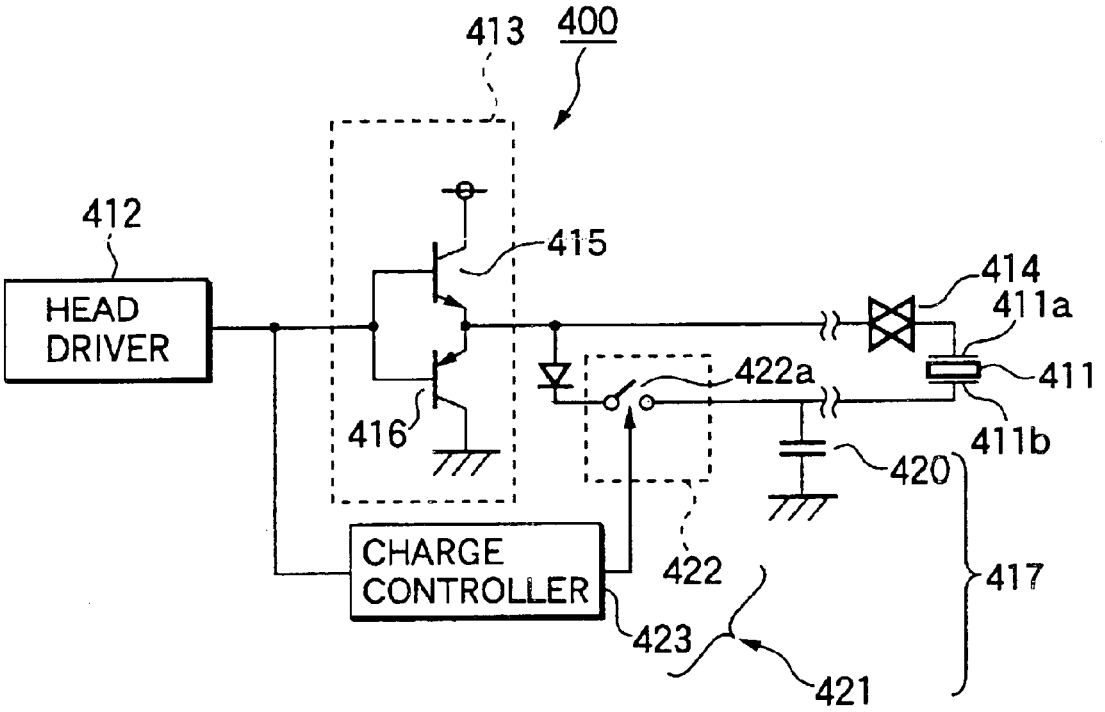
FIG.13A
FIG.13B
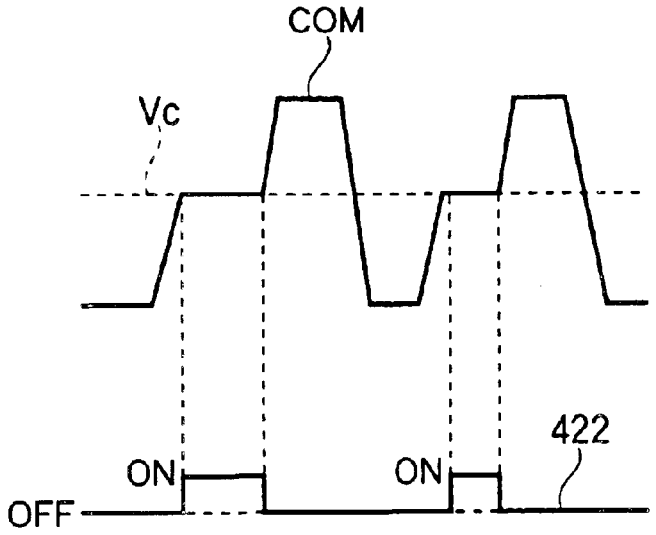

LIQUID JETTING APPARATUS AND METHOD FOR DRIVING THE SAME

BACKGROUND OF THE INVENTION

The present invention relates to a liquid jetting apparatus such as an ink jet printer and a method of driving the same. Particularly, the present invention relates to an apparatus and a method for driving piezoelectric elements provided with a print head in an ink jet printer, so that ink droplets are ejected from nozzle orifices formed with the print head.

An ink jet color printer of a type in which ink of several colors is ejected from a print head has spread up to now, and it has been widely used in order to print images processed by a computer with multi-colors and multi-tones.

For example, in an ink jet printer using a piezoelectric element as a drive element for ink ejection, plural piezoelectric elements associated with nozzles are selectively driven thereby to generate dynamic pressure to eject ink droplets from the nozzles. Printing is performed such that the ink droplets are landed on a print sheet to form ink dots thereon.

Each piezoelectric element is driven by a drive signal supplied from a driver circuit (driver IC) mounted in a printer body or a print head thereby to eject the ink droplets from the nozzles.

When the piezoelectric element is not driven (that is, when the printing is not performed), electric charges accumulated therein are discharged by inherent insulation resistance, so that a thus lowered potential of the piezoelectric element happens to affect the ink ejection.

In view of the above, Japanese Patent No. 3097155 discloses a head driving apparatus and a head driving method, in which charging voltage is applied to piezoelectric elements in accordance with charge signals when the piezoelectric elements are not driven, in order to keep a charged potential.

To drive the print head in such a way, a drive signal applied to each piezoelectric element is so configured as to have a high potential for deactivating the piezoelectric element and to have a lower potential for activating the same. Therefore, consumed power becomes large and the voltage applied to the piezoelectric element becomes relatively high, so that voltage drop due to the discharge (i.e., power loss) is also becomes large.

Increasing the number of piezoelectric elements arranged in a unit area is increased to improve the print quality, the distance between adjacent piezoelectric elements is accordingly reduced. In a case where an activated element and a deactivated element are juxtaposed, discharging between the adjacent elements would occur because of a potential difference caused by the voltage drop.

In the above case, the breakdown voltage of each element becomes low. Therefore, in a case where the drive signal having the maximum voltage higher than the breakdown voltage is applied to such an element, desired operation would not be attained. To avoid such a situation, it is necessary to apply insulation processing between the adjacent elements (e.g., filling an insulating material).

In a case where a charging voltage is suddenly applied to the piezoelectric element in which such voltage drop is occurred, there is a probability that the element happens to be driven so that ink drops are ejected unintentionally. To avoid such a situation, it is necessary to consider the timing of applying the charge signal when designing the drive signal.

SUMMARY OF THE INVENTION

It is therefore an object of the invention to provide, with simple configuration, an apparatus and a method for driving a print head in an ink jet printer, which lowers a potential difference between electrodes of each piezoelectric element, and reduces a voltage drop occurring therein due to discharging, while eliminating erroneous operations thereof.

In order to achieve the above object, according to the present invention, there is provided a head driving apparatus, incorporated in an ink jet printer which comprises:

- a print head, provided with a plurality of nozzles;
- piezoelectric elements, each associated with one of the nozzles and provided with a drive electrode and a common electrode; and
- a head driver, which generates a drive signal for driving the piezoelectric elements, and selectively supplies the drive signal to at least one of the piezoelectric elements to eject an ink droplet from at least one associated nozzle, the head driving apparatus comprising:
  - a bias power source, which applies a bias voltage having a predetermined potential to the common electrode of each piezoelectric element.

In this apparatus, by directly applying the bias voltage to the common electrode of the piezoelectric element from the bias power source, the potential of the piezoelectric element is held at the bias voltage. Consequently, since the voltage applied between both electrodes of the piezoelectric element becomes relatively low, consumed power is reduced.

Further, since the predetermined bias voltage is always applied to the common electrode of the piezoelectric element, leak current is reduced even if natural discharge of the piezoelectric element occurs, so that the voltage drop is reduced. Therefore, not only power loss is reduced, but also the steep voltage variation can be avoided when the piezoelectric element is charged so that the occurrence of the erroneous operation of the piezoelectric element can be eliminated. In addition, the restriction on the waveform design for placing the charge signal in the drive signal can be relaxed.

Further, since the voltage applied to the piezoelectric element becomes relatively low, occurrence of the discharge due to the voltage difference between the driven piezoelectric element and the non-driven piezoelectric element is also reduced. Even if the number of the piezoelectric elements per a unit area is increased while each size of the piezoelectric element is made small (the breakdown voltage becomes low), the piezoelectric element can normally operate without performing the insulation processing between the electrodes of the piezoelectric elements.

Preferably, the potential of the bias voltage is variable.

In this apparatus, the bias voltage can be controlled in accordance with the reference potential of the drive signal applied to the piezoelectric element which is inherent of each ink jet printer. Therefore, the voltage applied between both electrodes of each piezoelectric element can be set lower.

Preferably, the bias power source is provided as a logic power source.

In this apparatus, the bias power source can be constituted simply, readily and at a low cost.

Preferably, the bias power source generates the bias voltage based on a power supplied from a power source for driving the print head.

In this apparatus, since the bias voltage is generated using the existing head driving power source, it is not necessary to provide, for example, a logic power source, and the bias voltage can be obtained by the simple construction and at a low cost.

Here, it is preferable that the bias power source includes: a condenser, electrically connected to the common electrode; and a constant-voltage circuit, which applies the bias voltage to the condenser.

In this apparatus, the potential of the common electrode of the piezoelectric element is held at the bias voltage applied from the condenser.

Further, it is preferable that the constant-voltage circuit includes a Zener diode, a current limiting resistance and a coupling element. The Zener diode is electrically connected to the head driving power source through the current limiting resistance. The Zener diode is electrically connected to the common electrode through the coupling element.

In this apparatus, the condenser is charged by the stable bias voltage, and it is prevented by the coupling element that the electric charges discharged from the common electrode from flowing to the Zener diode.

Still further, it is preferable that the constant-voltage circuit includes a discharging diode electrically connected to the head driving power source in parallel with the current limiting resistance, such that a current is flowed to the head driving power source through the discharging diode.

In this apparatus, in a case that the potential of the head driving power source becomes to zero due to deactivation or the like, the electric charge charged in the condenser bypasses the current limiting resistance and is discharged through the discharging diode, whereby the condenser can be discharged quickly.

Preferably, the bias power source includes: a first condenser, electrically connected to the common electrode; and a charger, which charges the first condenser with electric charges discharged from the piezoelectric elements.

In this apparatus, the potential of the electrode of each piezoelectric element is held at the bias voltage applied from the first condenser, and it is not necessary to provide, for example, a logic power source, so that the bias voltage can be obtained at a low cost by the simple configuration.

Here, it is preferable that the charger includes a second condenser charged with the electric charges.

In this apparatus, the electrode of each piezoelectric element receives the stable bias voltage from the first condenser.

Further, it is preferable that the charger includes a constant-voltage circuit which regulates a charged voltage of the second condenser, and applies the charged voltage to the first condenser.

In this apparatus, fluctuation in the charged voltage of the first condenser is suppressed. Consequently, the bias voltage applied to the common electrode of the piezoelectric element is held more constantly.

In addition, it is preferable that the second condenser is charged before a printing operation is performed.

In this apparatus, the bias voltage applied from the first condenser to the common electrode also increases so that the erroneous operation of each piezoelectric element due to the increase of the bias voltage before the printing operation is prevented.

Preferably, it is preferable that the bias power source includes: a condenser, which apply the bias voltage to the common electrode; and a charger, which charges the condenser based on a power supplied from a power source for driving the print head. The bias voltage is substantially identical with an intermediate potential of the drive signal.

In this apparatus, since the voltage difference applied between the both electrodes of the piezoelectric element comes nearly to zero, the consumed power is reduced, the voltage drop due to the natural discharge of the piezoelectric element is reduced, and the power loss is reduced.

Here, it is preferable that the charger includes a switcher, which applies the intermediate potential to the condenser when the drive signal is not used for ejecting the ink drop.

In this apparatus, the potential of the common electrode of the piezoelectric element is held at the intermediate potential by the bias voltage applied from the condenser.

Further, it is preferable that the switcher is provided as a switching element.

In this apparatus, since the switching element may be controlled by a minute signal, the switcher can be readily controlled.

In addition, it is preferable that the switcher is controlled in accordance with the drive signal.

In this apparatus, the intermediate potential of the drive signal can be readily applied to the condenser, and the condenser can be charged.

Preferably, the bias power source is provided as a reference voltage generator which applies a reference voltage having a potential which is substantially identical with an intermediate potential of the drive signal, to the common electrode.

In this apparatus, since the voltage difference applied between the both electrodes of the piezoelectric element becomes relatively low, the consumed power is reduced, the voltage drop due to the natural discharge of the piezoelectric element is reduced, and the power loss is reduced.

Further, heat generation of the piezoelectric element is reduced, so that characteristic change of the piezoelectric element due to a change in temperature decreases. Even if operation characteristic of the piezoelectric element changes due to the temperature, since the reference voltage generator holds always the potential of the piezoelectric element at the intermediate potential, temperature correction is not required.

Here, it is preferable that the head driving apparatus further comprises a charger which generates a charge signal for charging at least one of the piezoelectric elements when the drive signal is not used for ejecting the ink drop. The reference voltage generator includes: a voltage holder, which latches an arbitrary potential of the drive signal based on the charge signal; and an current amplifier, which current-amplifies a voltage output from the voltage holder.

In this apparatus, not only the desired reference voltage can be generated, but also the electrode of the piezoelectric element is charged by the relatively large current. Further, since the potential of the common electrode of the piezoelectric element can be held at the intermediate potential, it is not necessary to provide a variable power source.

Further, since it is not necessary to provide another power line, the existing circuit can be utilized as it is.

Here, it is preferable that the reference voltage is applied when the charger charges the at least one of the piezoelectric elements, based on the output voltage of the voltage holder.

In this apparatus, since the both electrodes of the piezoelectric element are respectively charged without producing the mutual voltage difference, the erroneous operation of the piezoelectric element is prevented. Consequently, charging of the piezoelectric element before the printing operation can be performed quickly.

In addition, it is preferable that the reference voltage generator discharges at least one of the piezoelectric elements when a potential of the drive signal is higher than the intermediate potential while a printing operation is performed. The reference voltage generator charges at least one of the piezoelectric elements when the potential of the drive signal is lower than the intermediate potential while the printing operation is performed.

In this apparatus, since the potential of the common electrode of the piezoelectric element is held at the intermediate potential, the bi-directional variable power source is not required.

Here, it is preferable that the reference voltage generator includes a discharger which discharges at least one of the piezoelectric elements.

In this apparatus, in a case that the potential of the piezoelectric element is higher than the intermediate potential, discharging is performed through the discharger, whereby the potential of the piezoelectric is held at the intermediate potential.

In order to obtain the above advantages, according to the present invention, there is provided a liquid jetting apparatus, comprising:

a jetting head, provided with a plurality of nozzles;

piezoelectric elements, each associated with one of the nozzles and provided with a drive electrode and a common electrode; and the above-described head driving apparatus.

In order to obtain the above advantages, according to the present invention, there is provided a method of driving a jetting head in a liquid jetting apparatus, comprising the steps of:

providing a liquid jetting apparatus which comprises:

a jetting head, provided with a plurality of nozzles;

piezoelectric elements, each associated with one of the nozzles and provided with a drive electrode and a common electrode; and a head driver, which generates a drive signal for driving the piezoelectric elements, and selectively supplies the drive signal to at least one of the piezoelectric elements to eject an ink droplet from at least one associated nozzle;

providing a bias power source in the liquid jetting apparatus; and applying a bias voltage having a predetermined potential from the bias power source to the common electrode of each piezoelectric element.

Preferably, the head driving method further comprises the step of charging at least one of piezoelectric elements when the drive signal is not used for ejecting the ink drop.

Preferably, the head driving method further comprises the steps of:

determining a reference potential in the drive signal;

discharging at least one of the piezoelectric elements when a potential of the drive signal is higher than the reference potential while a printing operation is performed; and charging at least one of the piezoelectric elements when the potential of the drive signal is lower than the reference potential while the printing operation is performed.

Preferably, the head driving method further comprises the step of varying a potential of the bias voltage so as to follow a potential of the drive signal when the drive signal is not used for ejecting the ink drops.

Preferably, the head driving method further comprises the steps of:

determining a reference potential as an intermediate potential of the drive signal; and adjusting the bias voltage based on the reference potential.

BRIEF DESCRIPTION OF THE DRAWINGS

The above objects and advantages of the present invention will become more apparent by describing in detail preferred exemplary embodiments thereof with reference to the accompanying drawings, wherein:

FIG. 12 is a block diagram showing the configuration of a head driving apparatus according to a fourth embodiment of the invention;

FIGS. 13A and 13B are time charts showing a drive signal of a head driver and a signal level of a switcher in the head driving apparatus shown in FIG. 12;

DETAILED DESCRIPTION OF THE PREFERRED EMBODIMENTS

Preferred embodiments of the invention will be described below with reference to the accompanying drawings.

Figure 1:
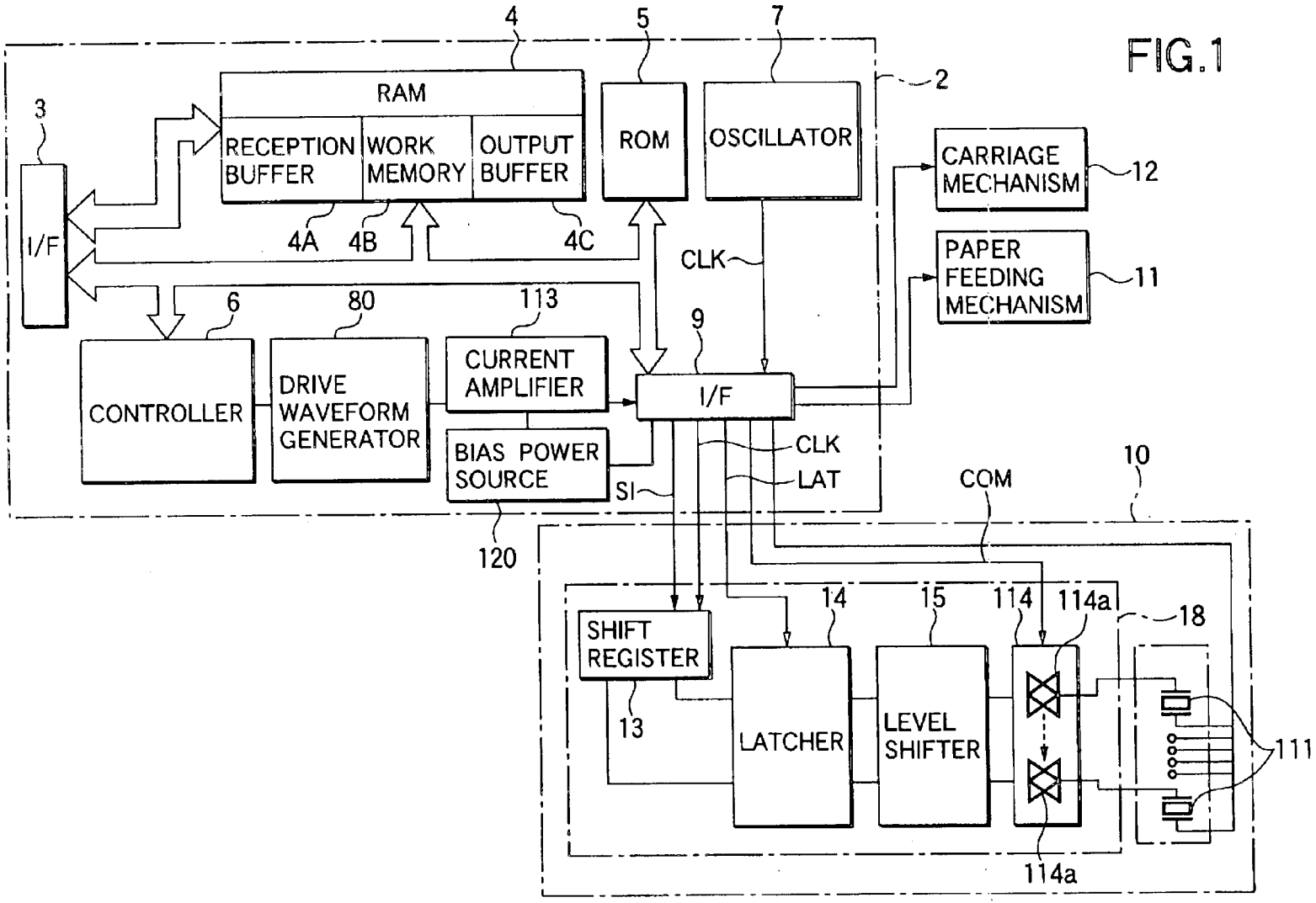
FIG. 1 is a function block diagram showing the whole configuration of an ink jet printer using a head driving apparatus of the invention.

FIG. 1 is a function block diagram showing the whole configuration of an ink jet printer using a head driving apparatus of the invention. The ink jet printer comprises a printer body 2, a carriage mechanism 12, a sheet feeding mechanism 11, and a print head 10. The sheet feeding mechanism 11 comprises a sheet feeding motor (not shown) and a sheet feeding roller (not shown), and successively feeds out a recording medium (not shown) such as a print sheet in a sub-scanning direction. The carriage mechanism 12 comprises a carriage (not shown) on which the print head is mounted, and a carriage motor (not shown) which moves this carriage in a main scanning direction through a timing belt (not shown).

The printer body 2 comprises an interface 3 that receives print data including multi-value hierarchical data from a host computer (not shown), a RAM 4 that records various data such as the print data, a ROM 5 that stores a routine for performing various data processing, a controller 6 comprising a CPU, an oscillator 7, and an interface 9 that transmits dot pattern data SI obtained from the print data to the print head 10.

Here, the print head 10 is electrically connected to the printer body 2 through a flexible flat cable (not shown). As shown in FIG. 1, the printer body 2 includes a drive waveform generator 80, a current amplifier 113 connected to this drive waveform generator 80, and a bias power source 120 connected to this current amplifier 113. Functions of these drive waveform generator 80, the current amplifier 113 and the bias power source 120 will be described later.

The print data from the host computer is held in a reception buffer 4A in the printer through the interface 3. The print data held in the reception buffer 4A is command-analyzed, and processing for adding a printing position, a size, a font address or the like of each character are performed by the controller 6. Next, the controller 6 converts the analyzed data into print image data (dot pattern data) SI and stores in an output buffer 4C. Further, the RAM 4 includes a work memory 4B (work area) that stores various work data temporarily.

When the print image data corresponding to one main scanning of the print head 10 is obtained, it is serial-transmitted through the interface 9 to the print head 10. The print head 10 has plural nozzle orifices from which ink drops are ejected. In this embodiment, 96 nozzle orifices are arranged in the sub-scanning direction.

A head driver 18 includes a shift register 13, a latcher 14, a level shifter 15 and plural analog switches 114*a*. In synchronization with a clock signal (CLK) from the oscillator 7, the print image data SI on the printer body 2 side is serial-transmitted from the interface 9 to the shift register 13. This serial-transmitted print image data SI is once latched by the latcher 14. The level shifter 15, that is a voltage booster, boosts the potential of the latched print image data SI, to a potential (e.g., tens of volts) capable of driving each analog switch 114*a*. The print image data SI having the boosted potential is applied to the analog switch 114*a* as a drive signal COM.

In addition to the head driver 18, the print head 10 is provided with plural piezoelectric elements 111. The drive signal COM is applied to a piezoelectric element which is associated with an activated analog switch 114*a* so that the subject piezoelectric element pressurizes ink in an associated pressure generating chamber to eject an ink drop from an associated nozzle orifice.

Figure 2:
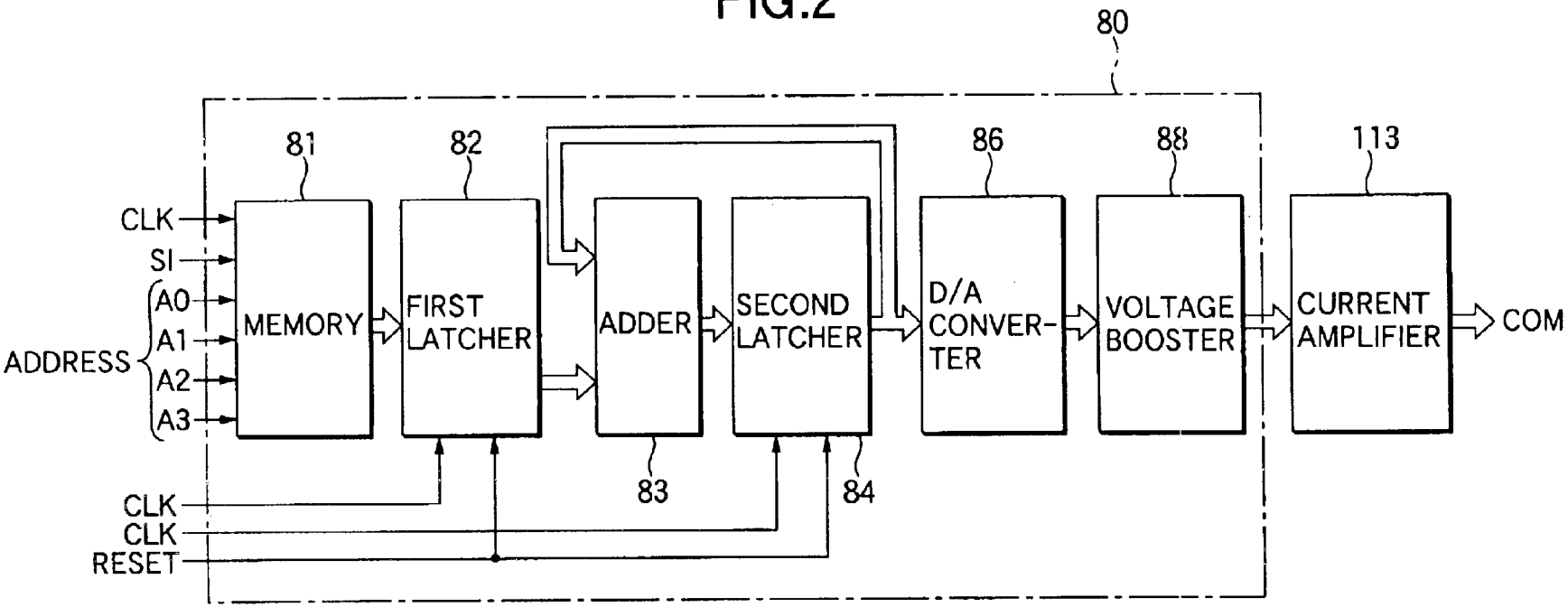
FIG. 2 is a function block diagram showing the internal configuration of a drive waveform generator in the ink jet printer shown in FIG. 1.

As shown in FIG. 2, the drive waveform generator 80 comprises a memory 81 that stores drive waveform data given by the controller 6, a first latcher 82 that holds temporarily the drive waveform data read out from the memory 81, a second latcher 84 described later, an adder 83 that adds the output of the first latcher 82 and the output of the second latcher 84, a D/A converter 86 that converts the output of the second latcher 84 into analog data, and a voltage booster 88 that boosts the voltage of the converted analog signal up to the voltage of the drive signal.

Here, the memory 81 is used in order to store a predetermined parameter that determines a waveform of the drive signal. As described later, the waveform of the drive signal COM is previously determined by the predetermined parameter received from the controller 6. Further, the electric current of the drive waveform signal of which the voltage has been boosted by the voltage booster 88 is amplified by the current amplifier 113 up to the electric current capable of driving the analog switch 114*a*. As shown in FIG. 1, the output side of the current amplifier 113 is connected to the plural analog switches 114*a* of the head driver 18, and each analog switch 114*a* is connected to the corresponding piezoelectric element 111.

On a nozzle formation face of the print head, the plural nozzles (for example, 96 nozzles per a line) are arranged in three rows associated with three colors of cyan, magenta and yellow (in this embodiment, black is composite black formed by composing the three colors). Vibrating the piezoelectric elements 111 respectively associated with the plural nozzles, ink in associated pressure generating chambers are pressurized to be ejected as ink drops therefrom.

Figure 3:
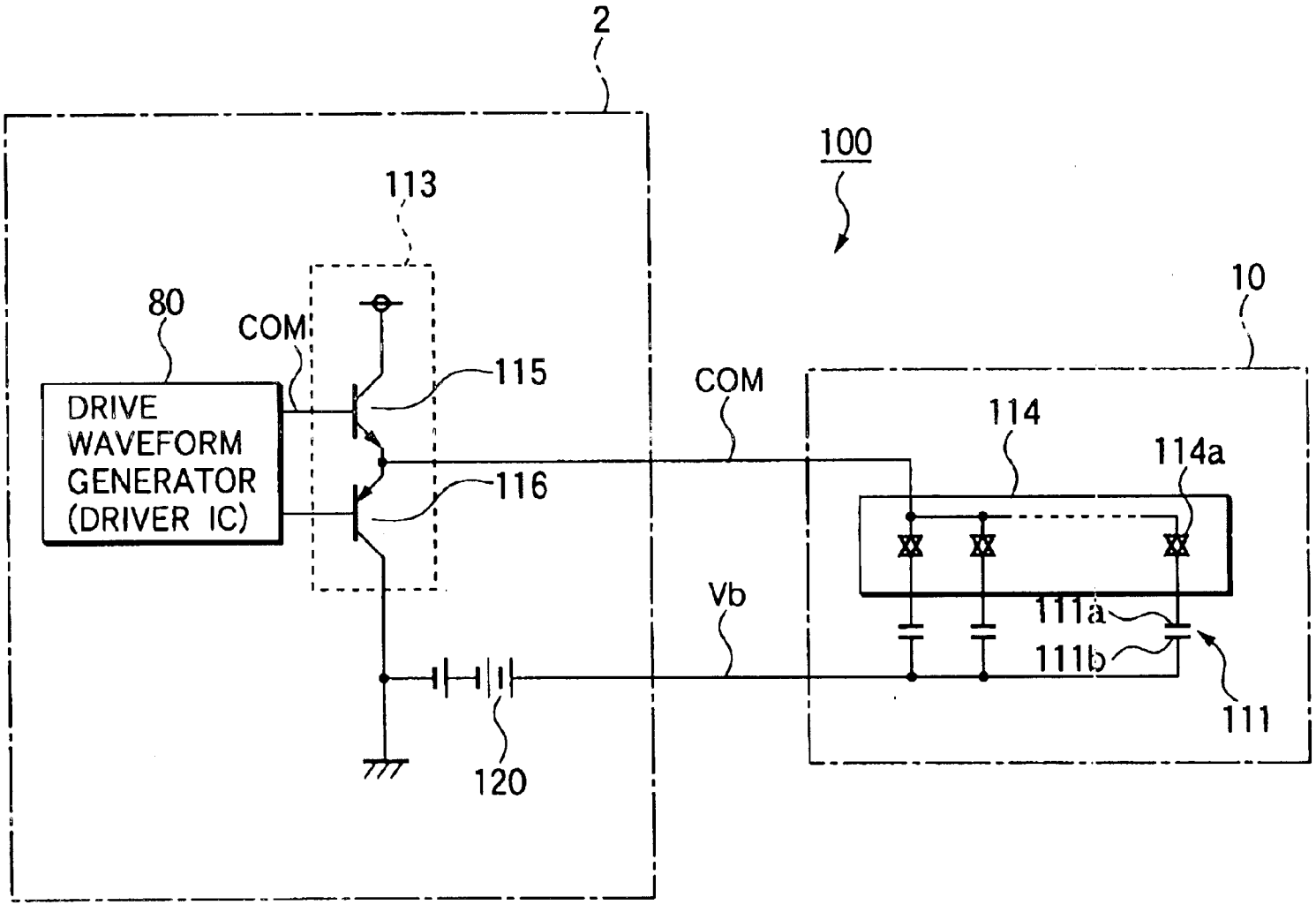
FIG. 3 is a block diagram showing the configuration of a head driving apparatus according to a first embodiment of the invention.

FIG. 3 shows the configuration of a head driving apparatus according to a first embodiment of the invention. A head driving apparatus 100 comprises: piezoelectric elements 111 respectively provided correspondingly to plural nozzles in the print head 10 of the ink jet printer; plural analog switches 114*a* provided correspondingly to each piezoelectric element; the drive waveform generator 80 which supplies a drive signal COM to a drive electrode 111*a* of each piezoelectric element 111; the current amplifier 113; and the bias power source 120 that applies a predetermined voltage to a common electrode 111*b* of each piezoelectric element 111.

The piezoelectric element 111 is deformed by the voltage applied between both electrodes 111*a* and 111*b*. And, the piezoelectric element 111 is always charged at a potential near an intermediate potential Vc of the drive signal COM. When the piezoelectric element 111 discharges on the basis of the drive signal COM, ink in the corresponding nozzle is pressurized so that an ink droplet is ejected therefrom.

The drive waveform generator 80 is constituted as a driver IC. The current amplifier 113 comprises two transistors 115 and 116. In a first transistor 115, a collector is connected to a constant-voltage power source (for example, 42V), a base is connected to the output of the drive waveform generator 80, and an emitter is connected to the input side of each analog switch 114*a*. Hereby, the conduction of the first transistor 115 is established on the basis of a signal from the drive waveform generator 80, and supplies the constant voltage through each analog switch 114*a* to the piezoelectric element 111.

Further, in a second transistor 116, an emitter is connected to the input side of each analog switch 114*a*, a base is connected to the output of the drive waveform generator 80, and a collector is grounded. Hereby, the conduction of the second transistor 116 is established on the basis of a signal from the drive waveform generator 80, and discharges the piezoelectric element 111 through each analog switch 114*a*.

When one piezoelectric element 111 is driven, the print image data SI is input into an associated analog switch 114*a* to be turned on, so that the drive signal COM is supplied to the piezoelectric element 111. Namely, the plural analog switches 114*a* serve as a transmission gate 114 for performing on/off operation of each piezoelectric element 111.

The bias power source 120 applies a predetermined bias voltage Vb lower than the intermediate potential Vc to the common electrode 111*b* of the piezoelectric element 111. Here, the bias power source 120 is specifically composed of a logic power source of, for example, output voltage 5 V so that it can adjust the bias voltage Vb to the desired voltage.

The head driving apparatus 100 is operated as described below. Firstly, the operation of driven piezoelectric element 111 for printing will be described. At the time T1 at which the printing is started, a charge signal NCHG is turned to L level for a predetermined time period (e.g., 100 $\mu$s) as shown in FIG. 4C, so that the potential of the drive signal COM generated from the drive waveform generator 80 increases up to the intermediate potential Vc as shown in FIG. 4A.

Hereby, the electric current, on the basis of the drive signal COM, flows from the first transistor 115 of the current amplifier 113 through each analog switch 114*a* to the drive electrode 111*a* of each piezoelectric element 111. Thereby the electrodes 111*a* is charged such that the potential thereof increases up to the intermediate potential Vc as shown by a solid line in FIG. 4B.

Figures 4A, 4B, 4C:
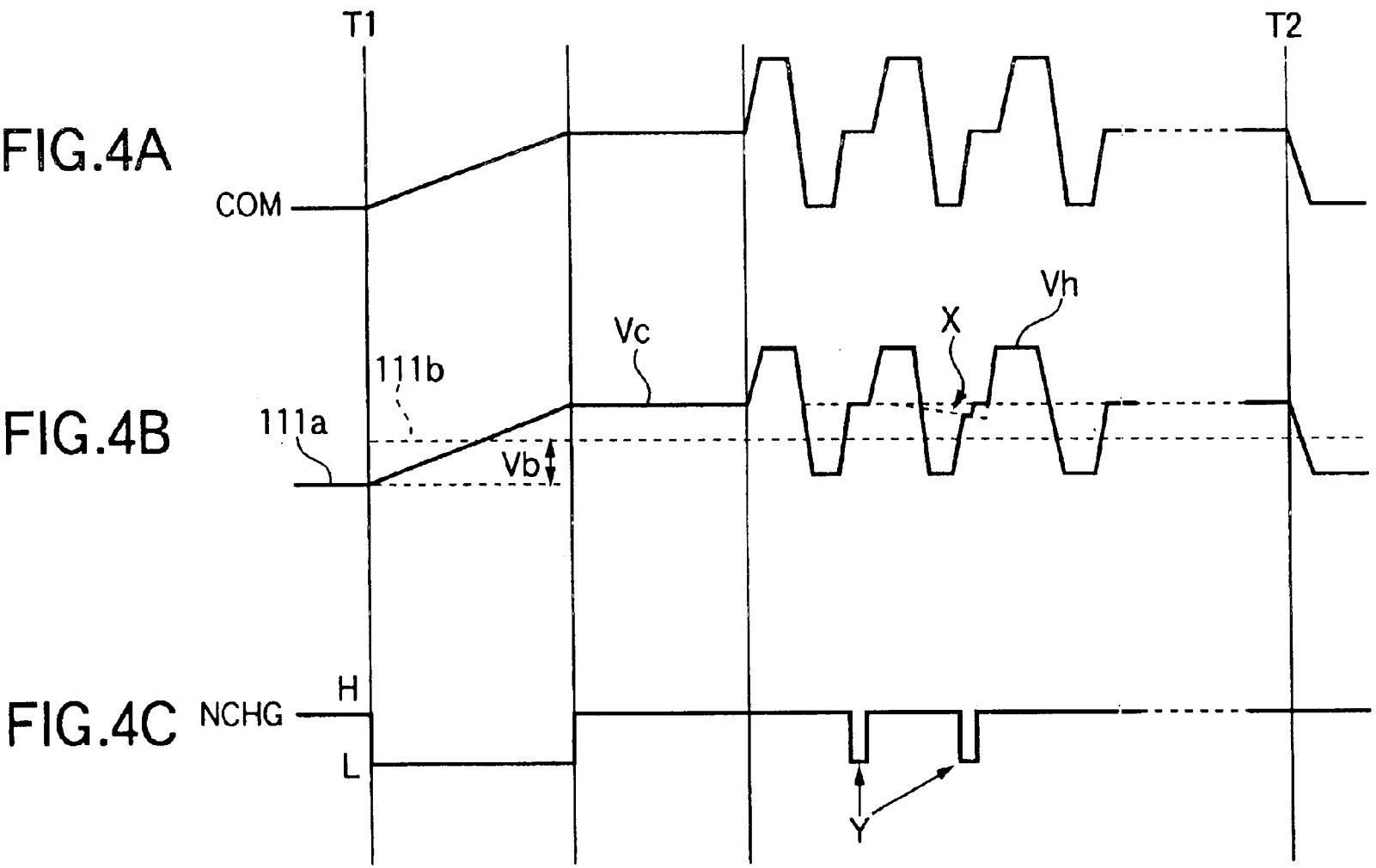
FIGS. 4A, 4B and 4C are time charts respectively showing a drive signal, potentials of both electrodes of a piezoelectric element, and a charge signal in the head driving apparatus shown in FIG. 3.

At this time, the common electrode 111*b* of each piezoelectric element 111 receives the bias voltage Vb from the bias power source 120, whereby the potential of the common electrode 111*b* is held at the predetermined voltage Vb as shown by a dashed line in FIG. 4B.

The ratio $\alpha$ of the intermediate voltage Vc to the maximum voltage Vh of the drive signal COM is set to, for example, 0.5 ($Vc=\alpha \cdot Vh$).

During the printing operation, on the basis of the variation of the drive signal COM, charging is performed to the drive electrode 111*a* through the first transistor 115, and discharging is performed from the drive electrode 111*a* through the second transistor 116. Hereby, the piezoelectric element 111 operates on the basis of the drive signal COM thereby to eject the ink droplet.

Here, in order to prevent the piezoelectric element 111 from causing voltage drop due to self-discharge on the way as indicated by a reference character X in FIG. 4B, and prevent the potential of the electrode 111*a* from being lower than the intermediate potential Vc, the charge signal NCHG is turned to L level at a predetermined cycle associated with the drive signal COM, and a predetermined timing when the potential of the drive signal COM is not varied, as shown by a reference character Y in FIG. 4C.

Hereby, on the basis of the drive signal COM, the drive electrode 111*a* of the piezoelectric element 111 is charged trough the first transistor 115 of the current amplifier 113, so that also the potential of the non-driven piezoelectric element is held at the intermediate potential Vc.

On the other hand, the common electrode 111*b* of each piezoelectric element 111 receives the bias voltage Vb from the bias power source 120, whereby its potential is held at this voltage Vb. Consequently, in each piezoelectric element 111, the potential difference between the both electrodes 111*a* and 111*b* is (Vc-Vb).

If the bias voltage Vb of the bias power source 120 is adjusted so as to become the same as the intermediate potential Vc, the potential difference between the both electrodes 111*a* and 111*b* becomes zero.

At the time T2 at which the printing is finished, as shown in FIG. 4B, the potential of the drive electrode 111*a* of the driven piezoelectric element 111 is lowered to zero while discharging through the second transistor 116 of the current amplifier 113 in accordance with the drive signal COM.

On the other hand, the potential of the drive electrode 111*a* of the non-driven piezoelectric element 111 is still charged and held in the intermediate voltage Vc due to the application of the charge signal NCHG.

Incidentally, since the potential of the electrode 111*b* of the piezoelectric element 111 is held at the constant potential by the bias voltage Vb from the bias power source 120, the potential difference between the both electrodes 111*a* and 111*b* of the piezoelectric element 111 is kept small.

Consequently, not only the consumed power in the piezoelectric element 111 is reduced, but also the voltage drop (power loss) due to the self-discharge of the piezoelectric element 111 is eliminated.

Even in a case that the driven piezoelectric element and the non-driven piezoelectric are adjacent to each other, the voltage difference between the electrodes 111*a* of these piezoelectric elements 111 is also kept small. Accordingly, since the discharging between the adjacent piezoelectric elements 111 are eliminated, it is not necessary to apply the insulation processing thereto even if the piezoelectric elements are crowdedly arranged.

In this embodiment, the bias power source 120 is constituted by the logic power source. However, a power source having another configuration may be adopted as long as it is constituted so that it is able to output the predetermined voltage.

Figure 5:
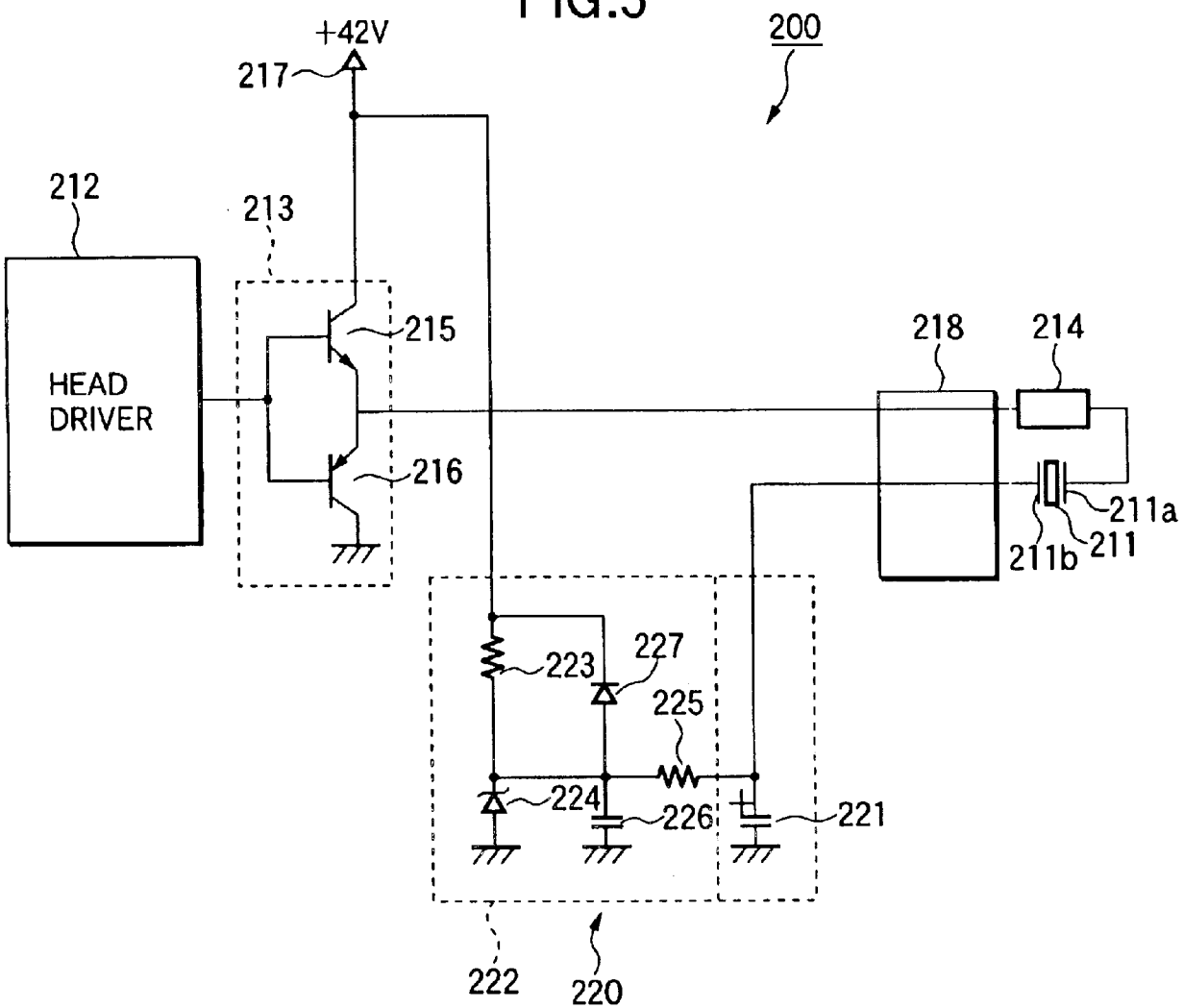
FIG. 5 is a block diagram showing the configuration of a head driving apparatus according to a second embodiment of the invention.

FIG. 5 shows the configuration of a head driving apparatus according to a second embodiment of the invention. A head driving apparatus 200 comprises: piezoelectric elements 211 respectively provided correspondingly to plural nozzles of the ink jet printer; a head driver 212 for supplying a drive signal to a drive electrode 211*a* of each piezoelectric element 211; a current amplifier 213 and a switcher 214 that are provided between this head driver 211 and each piezoelectric element 211; and a bias power source 220 that applies the predetermined bias voltage to a common electrode 211*b* of the piezoelectric element 211.

The single piezoelectric element 211 is shown in this figure, however, plural nozzles are actually provided with the print head of the ink jet printer, and one piezoelectric element is associated with each nozzle.

To each piezoelectric element 211, a drive signal COM from the head driver 212 is successively output, actually through a shift register.

Since the piezoelectric element 211 is the same as the piezoelectric element 111 in the head driving apparatus 100 shown in FIG. 3, its detailed description is omitted.

The head driver 212 is constituted as a driver IC, has the same configuration as the drive waveform generator 80 shown in FIG. 3, generates the drive signal COM for the print head of the ink jet printer, and is arranged in a printer body, for example.

The current amplifier 213 comprises two transistors 215 and 216 similarly to the current amplifier 113 shown in FIG. 3. In a first transistor 215, a collector is connected to a constant-voltage power source 217, a base is connected to the output of the head driver 212, and an emitter is connected to the input side of the switcher 214. Hereby, the conduction of the first transistor 215 is established on the basis of the signal from the head driver 212, and supplies the constant voltage through the switcher 214 to the piezoelectric element 211.

Here, the constant-voltage power source 217 is a power source of relatively high voltage, which supplies head driving voltage of, for example, DC 42 V.

In a second transistor 216, an emitter is connected to the input side of the switcher 214, a base is connected to the output of the head driver 212, and a collector is grounded. Hereby, the conduction of the second transistor 216 is established on the basis of the signal from the head driver 212, so that electric charge in the piezoelectric element 211 is discharged to the ground through the switcher 214.

The switcher 214 is an analog switcher, and actually includes, for each piezoelectric element, an analog switch (not shown) similar to the analog switch 114*a* in the head driving apparatus 100 shown in FIG. 3. Upon input of a control signal (print image data SI), the analog switch is turned on to output a drive signal COM to the piezoelectric element 211, at the timing to drive the corresponding piezoelectric element 211. Here, the piezoelectric element 211 and the switcher 214 are provided in the print head 10 and connected to the printer body 2 through a flexible flat cable 218.

The bias power source 220, as shown in FIG. 5, comprises a condenser 221 and a constant-voltage circuit 222 so that a predetermined potential, that is, a bias voltage Vb that is lower than an intermediate potential Vc by the drive signal COM of the piezoelectric element 211 is applied to the common electrode 211*b* of the piezoelectric element 211.

The condenser 221 is an electrolytic condenser, of which one end is connected to the common electrode 211*b* of the piezoelectric element 211 so as to apply its charged voltage, as the bias voltage Vb thereto, while the other end is grounded.

The capacity of the condenser 221 is set to be sufficiently greater than the total electrostatic capacity (about several $\mu$F) of all the piezoelectric elements 211, for example, about 1000 $\mu$F so that the stable bias voltage Vb can be supplied to each piezoelectric element 211.

To generate the bias voltage Vb using the constant-voltage power source 217 serving as the head driving power source, the constant-voltage circuit 222 comprises a current limiting resistance 223, a Zener diode 224, a coupling resistance 225 serving as a coupling element, an anti-noise condenser 226, and a discharging diode 227.

The current limiting resistance 223 and the Zener diode 224 are connected to each other in series between the constant-voltage power source 217 and the ground, and the voltage of the Zener diode 224 (the voltage on the opposite side to the ground of the Zener diode 224) is held at the predetermined potential, for example, DC 6 V. Here, as the current limiting resistance 223, a resistance of about several k Ω is used.

The coupling resistance 225 applies the voltage of the Zener diode 224 to the condenser 221, and separates the circuit so that the discharged voltage of the condenser 221 is not applied to the Zener diode 224. As the coupling resistance 225, a resistance of about tens Ω to several k Ω is used.

The anti-noise condenser 226 is used in order to absorb and remove noise components included in the voltage of the Zener diode 224, and it may be omitted.

The discharging diode 227 is used, in case that its voltage lowers to 0 V due to deactivation of the constant-voltage power source 217, in order to allow the electric charge charged in the condenser 221 to be discharged quickly while bypassing the current limiting resistance 223. This diode 227 may be omitted similarly.

The head driving apparatus 200 is operated as described below. Firstly, the operation of driven piezoelectric element 211 for printing will be described. At the time T1 at which the printing is started, a charge signal NCHG is turned to L level for a predetermined time period (e.g., 100 $\mu$s) as shown in FIG. 6C, so that the potential of the drive signal COM generated from the head driver 212 increases up to the intermediate potential Vc as shown in FIG. 6A.

Hereby, the electric current, on the basis of the drive signal COM, flows from the first transistor 215 of the current amplifier 213 through the switcher 214 to the drive electrode 211*a* of each piezoelectric element 211. Thereby the electrodes 211*a* is charged such that the potential thereof increases up to the intermediate potential Vc as shown by a solid line in FIG. 6B.

Figures 6A, 6B, 6C:
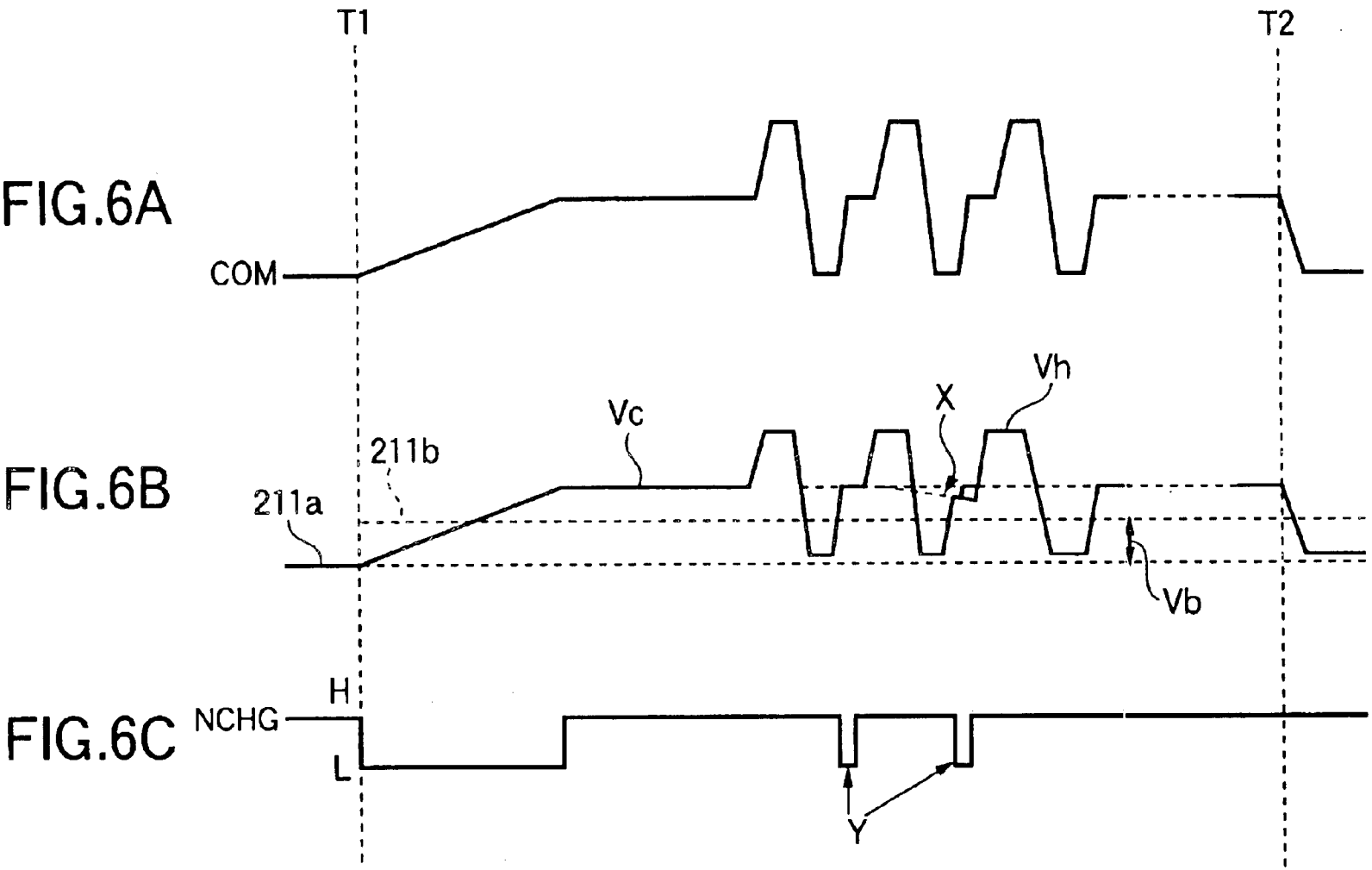
FIGS. 6A, 6B and 6C are time charts respectively showing a drive signal, potentials of both electrodes of a piezoelectric element, and a charge signal in the head driving apparatus shown in FIG. 5.

At this time, the common electrode 211*b* of each piezoelectric element 211 receives the bias voltage Vb from the bias power source 220, whereby the potential of the common electrode 211*b* is held at the predetermined voltage Vb as shown by a dashed line in FIG. 6B.

Since the potential of the electrode 211*b* of the piezoelectric element 211 is held at the predetermined voltage Vb, the potential difference between the both electrodes 211*a* and 211*b* is Vb when the printing is started. However, since this potential difference Vb is lower than the intermediate potential Vc of the drive signal COM, the piezoelectric element would not eject the ink droplet erroneously.

During the printing operation, on the basis of the variation of the drive signal COM, charging is performed to the drive electrode 211*a* through the first transistor 215, and discharging is performed from the drive electrode 211*a* through the second transistor 216 when the potential of the drive signal COM is lower than the intermediate potential Vc. Hereby, the piezoelectric element 211 operates on the basis of the drive signal COM thereby to eject the ink droplet.

Here, in order to prevent the piezoelectric element 211 from causing voltage drop due to self-discharge on the way as indicated by a reference character X in FIG. 6B, and prevent the potential of the electrode 211*a* from being lower than the intermediate potential Vc, the charge signal NCHG is turned to L level at a predetermined cycle associated with the drive signal COM, and a predetermined timing when the potential of the drive signal COM is not varied, as shown by a reference character Y in FIG. 6C.

Hereby, on the basis of the drive signal COM, the drive electrode 211*a* of the piezoelectric element 211 is charged trough the first transistor 215 of the current amplifier 213, so that also the potential of the non-driven piezoelectric element is held at the intermediate potential Vc. Since the voltage drop due to natural discharge of the piezoelectric element 211 is eliminated, the steep charging of the piezoelectric element 211 by the charge signal NCHG is prevented, so that the erroneous operation of the piezoelectric element 211 does not occur.

On the other hand, the common electrode 211*b* of each piezoelectric element 211 receives the bias voltage Vb from the bias power source 220, whereby its potential is held at this voltage Vb. Consequently, in each piezoelectric element 211, the potential difference between the both electrodes 211*a* and 211*b* is (Vc-Vb).

At the time T2 at which the printing is finished, as shown in FIG. 6B, the potential of the drive electrode 211*a* of the driven piezoelectric element 211 is lowered to zero while discharging through the second transistor 216 of the current amplifier 213 in accordance with the drive signal COM.

On the other hand, the potential of the drive electrode 211*a* of the non-driven piezoelectric element 211 is still charged and held in the intermediate voltage Vc due to the application of the charge signal NCHG.

Incidentally, since the potential of the electrode 211*b* of the piezoelectric element 211 is held at the constant potential by the bias voltage Vb from the bias power source 220, the potential difference between the both electrodes 111*a* and 111*b* of the piezoelectric element 211 is kept small.

Consequently, not only the consumed power in the piezoelectric element 211 is reduced, but also the voltage drop (power loss) due to the self-discharge of the piezoelectric element 211 is eliminated.

Even in a case that the driven piezoelectric element and the non-driven piezoelectric are adjacent to each other, the voltage difference between the electrodes 211*a* of these piezoelectric elements 211 is also kept small. Accordingly, since the discharging between the adjacent piezoelectric elements 211 are eliminated, it is not necessary to apply the insulation processing thereto even if the piezoelectric elements are crowdedly arranged.

In a case that the voltage of the constant-voltage power source 217 lowers to 0 V due to deactivation, it is necessary to discharge the condenser 221 of the bias power source 220. However, since the electric charge charged in the condenser 221 bypasses the current limiting resistance 223 so as to be discharged through the discharging diode 227, the discharging is performed quickly.

Further, since the bias power source 220 generates the bias voltage Vb using the constant-voltage power source 217 serving as the head driving power source, such a power source having the complicated configuration in which the logic power source is used is not required. Since the bias power source 220 itself comprises the condenser 221 and the constant-voltage circuit 222 including the current limiting resistance 223, the Zener diode 24 and the coupling resistance 225 serving as the coupling element, the bias power source 220 can be obtained at a low cost. Thus, a cost of whole of the head driving apparatus 200 can be reduced.

In this embodiment, as the coupling element of the bias power source 220, the coupling resistance 225 is used. However, a coil may be used as the coupling element.

Figure 7:
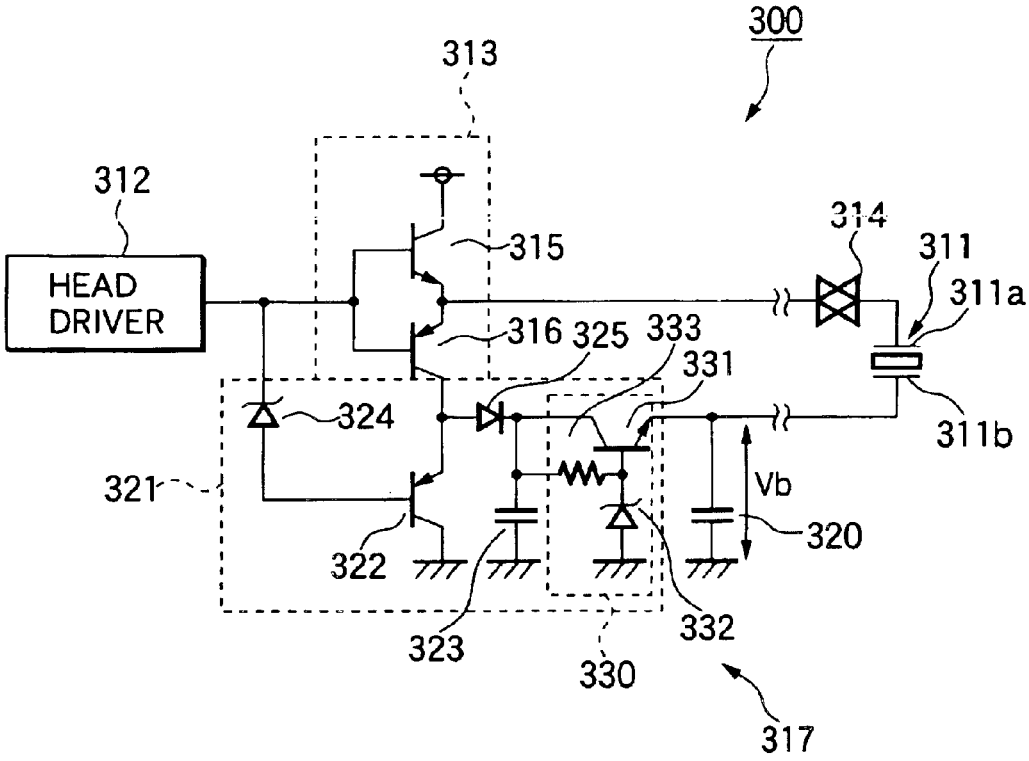
FIG. 7 is a block diagram showing the configuration of a head driving apparatus according to a third embodiment of the invention.

FIG. 7 shows the configuration of a head driving apparatus according to a third embodiment of the invention. A head driving apparatus 300 comprises piezoelectric elements 311 respectively provided correspondingly to plural nozzles of the ink jet printer; a head driver 312 for supplying a drive signal to a drive electrode 311*a* of each piezoelectric element 331; a current amplifier 313 and a switcher 314 that are provided between this head driver 312 and each piezoelectric element 311; and a bias power source 317 that applies the predetermined bias voltage to a common electrode 311*b* of the piezoelectric element 311.

Since the piezoelectric element 311, the head driver 312, the current amplifier 313 and the switcher 314 are the same as the piezoelectric element 211, the head driver 212, the current amplifier 213 and the switcher 214 in the head driving apparatus 200 shown in FIG. 5, their detailed description is omitted.

The bias voltage circuit 317 comprises: a first condenser 320 that applies a predetermined voltage to the common electrode 311*b* of the piezoelectric element 311; and a charger 321.

In the first condenser 320, one end is connected to the common electrode 311*b* of the piezoelectric element 311 so as to apply its charged voltage, as the bias voltage Vb, to the common electrode 311*b* of each piezoelectric element 311, while the other end is grounded.

To supply stable bias voltage to each piezoelectric element 311, the capacity of the first condenser 320 is set to be sufficiently greater than the total electrostatic capacity (about several $\mu$F) of all the piezoelectric elements 311, for example, about 100 $\mu$F to several 1000 $\mu$F.

The charger 321 comprises a third transistor 322, a second condenser 323, and a constant-voltage circuit 333. In the third transistor 322, an emitter is connected to a collector of a second transistor 316 in the current amplifier 313, a collector is grounded, and a base is connected through a constant-voltage diode 324 to the head driver 312.

Figure 8A:
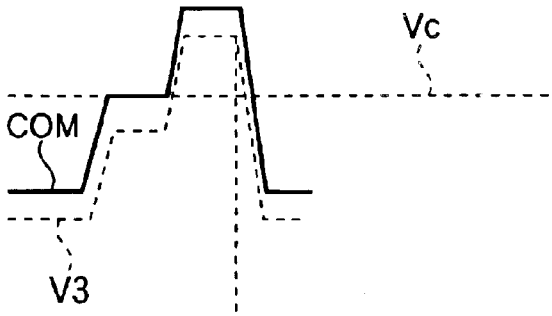
FIGS. 8A and 8B a time charts respectively showing a base potential of a third condenser of a charge circuit and a current of a diode of a charger in the head driving apparatus shown in FIG. 7.

Hereby, to the base of the third transistor 322, as shown by a dashed line in FIG. 8A, the voltage V3 is applied, which is lower than the voltage of the drive signal COM by the voltage by the constant-voltage diode 324. Consequently, the third transistor 322 conducts to the drive signal COM only when the voltage V3 is higher than the intermediate potential Vc.

In the second condenser 323, one end is connected through a diode 325 to the emitter of the third transistor 322 and the collector of the second transistor 316 in the current amplifier 313, while the other end is grounded. The second condenser 323, by receiving the constant-voltage through the high resistance, may be charged always or before printing is started, and it may be charged so that the voltage gradually increases by a not-shown member at the print starting time.

The constant-voltage circuit 330, in the figure, is a well-known constant-voltage circuit, and comprises a fourth transistor 331, a constant-voltage diode 332 and a resistance 333.

In the fourth transistor 331, a collector is connected to one end of the second condenser 323, an emitter is connected to one end of the first condenser 320, and a base is connected to the constant-voltage diode 332. The other end of the constant-voltage diode 332 is grounded. One end of the resistance 333 is connected to one end of the second condenser 323, and the other end thereof is connected to a base of the fourth transistor 331.

The head driving apparatus 300 is operated as described below. Firstly, the operation of driven piezoelectric element 311 for printing will be described. At the time T1 at which the printing is started, a charge signal NCHG is turned to L level for a predetermined time period (e.g., 100 $\mu$s) as shown in FIG. 9C, so that the potential of the drive signal COM generated from the head driver 312 increases up to the intermediate potential Vc as shown in FIG. 9A.

Hereby, the electric current, on the basis of the drive signal COM, flows from the first transistor 315 of the current amplifier 313 through the switcher 314 to the drive electrode 311*a* of each piezoelectric element 311. Thereby the electrodes 311*a* is charged such that the potential thereof increases up to the intermediate potential Vc as shown by a solid line in FIG. 9B.

Figures 9A, 9B, 9C:
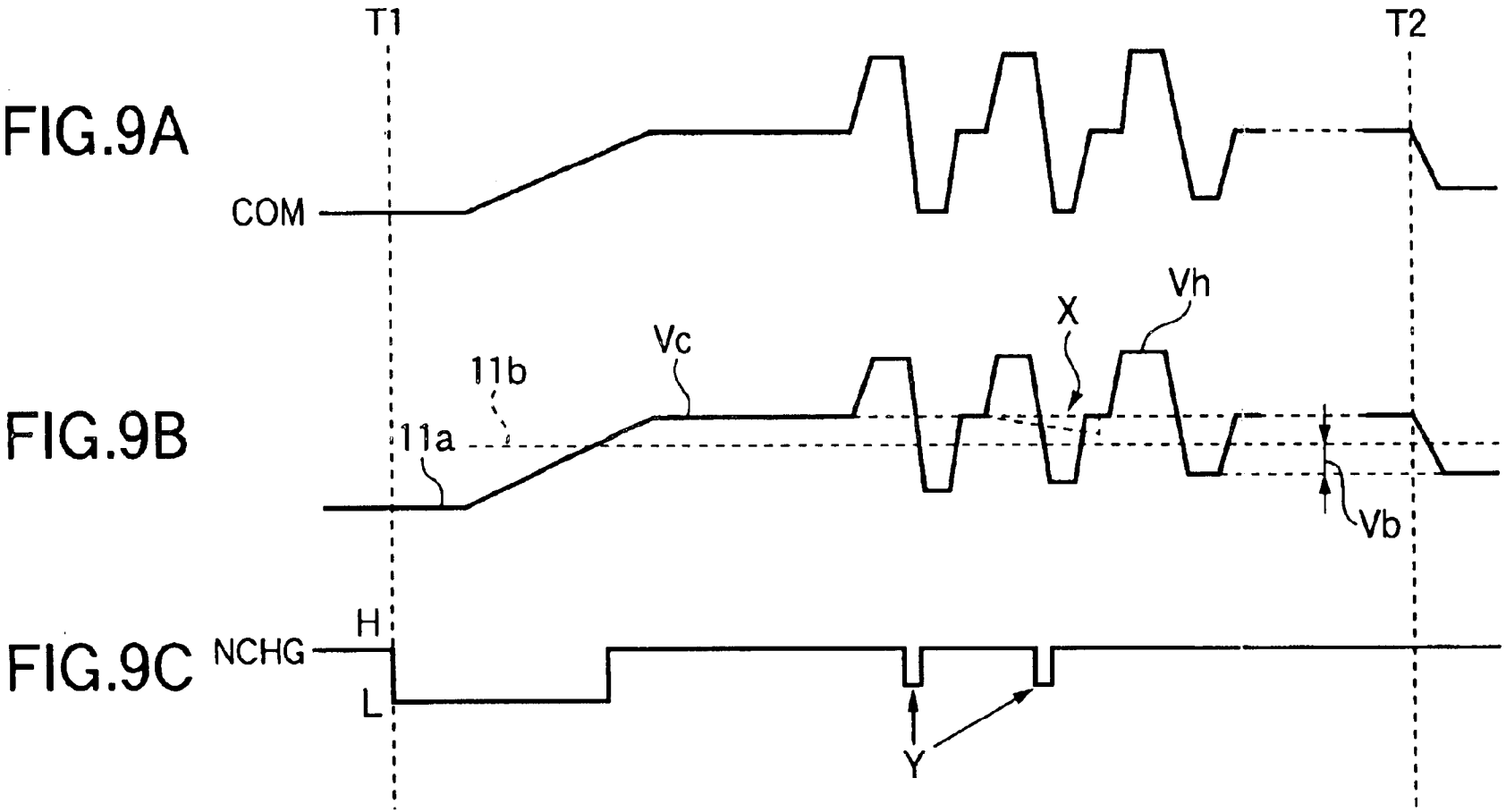
FIGS. 9A, 9B and 9C are time charts respectively showing a drive signal, potentials of both electrodes of a piezoelectric element, and a charge signal in the head driving apparatus shown in FIG. 7.

At this time, the common electrode 311*b* of each piezoelectric element 311 receives the charged voltage of the first condenser 320 as the bias voltage Vb from the bias power source 317, whereby the potential of the common electrode 311*b* is held at the predetermined voltage Vb as shown by a dashed line in FIG. 9B.

Since the potential of the electrode 311*b* of the piezoelectric element 311 is held at the predetermined voltage Vb, the potential difference between the both electrodes 311*a* and 311*b* is Vb when the printing is started. However, since this potential difference Vb is lower than the intermediate potential Vc of the drive signal COM, the piezoelectric element would not eject the ink droplet erroneously.

During the printing operation, on the basis of the variation of the drive signal COM, charging is performed to the drive electrode 311*a* through the first transistor 315, and discharging is performed from the drive electrode 311*a* through the second transistor 316 when the potential of the drive signal COM is lower than the intermediate potential Vc. Hereby, the piezoelectric element 311 operates on the basis of the drive signal COM thereby to eject the ink droplet.

Figure 8B:
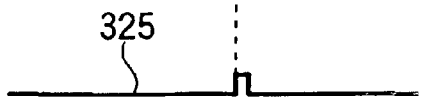

The discharged electric charge is, as shown in FIG. 8B, stored in the second condenser 323 through the diode 325, whereby the second condenser 323 is charged.

Here, in order to prevent the piezoelectric element 311 from causing voltage drop due to self-discharge on the way as indicated by a reference character X in FIG. 9B, and prevent the potential of the electrode 311*a* from being lower than the intermediate potential Vc, the charge signal NCHG is turned to L level at a predetermined cycle associated with the drive signal COM, and a predetermined timing when the potential of the drive signal COM is not varied, as shown by a reference character Y in FIG. 9C.

Hereby, on the basis of the drive signal COM, the drive electrode 311*a* of the piezoelectric element 311 is charged trough the first transistor 315 of the current amplifier 313, so that also the potential of the non-driven piezoelectric element is held at the intermediate potential Vc.

On the other hand, the common electrode 311*b* of each piezoelectric element 311 receives the bias voltage Vb from the first condenser 320 of the bias power source 317, whereby its potential is held at this voltage Vb. Consequently, in each piezoelectric element 311, the potential difference between the both electrodes 311*a* and 311*b* is (Vc-Vb).

If the bias voltage Vb of the first condenser 320 is adjusted so as to become the same as the intermediate potential Vc, the potential difference between the both electrodes 311*a* and 311*b* becomes zero.

At the time T2 at which the printing is finished, as shown in FIG. 9B, the potential of the drive electrode 311*a* of the driven piezoelectric element 311 is lowered to zero while discharging through the second transistor 316 of the current amplifier 313 in accordance with the drive signal COM.

On the other hand, the potential of the drive electrode 311*a* of the non-driven piezoelectric element 311 is still charged and held in the intermediate voltage Vc due to the application of the charge signal NCHG.

Incidentally, since the potential of the electrode 311*b* of the piezoelectric element 311 is held at the constant potential by the bias voltage Vb from the first condenser 320, the potential difference between the both electrodes 311*a* and 311*b* of the piezoelectric element 311 is kept small.

Consequently, not only the consumed power in the piezoelectric element 311 is reduced, but also the voltage drop (power loss) due to the self-discharge of the piezoelectric element 311 is eliminated.

Even in a case that the driven piezoelectric element and the non-driven piezoelectric are adjacent to each other, the voltage difference between the electrodes 311*a* of these piezoelectric elements 311 is also kept small. Accordingly, since the discharging between the adjacent piezoelectric elements 311 are eliminated, it is not necessary to apply the insulation processing thereto even if the piezoelectric elements are crowdedly arranged.

Further, since the first condenser 320 in the bias power source 317 and the second condenser 323 in the charger 321 are charged using the discharged electric charge from each piezoelectric element 311, a power source such as a logic power source for generating the bias voltage Vb is not particularly required.

Figure 10:
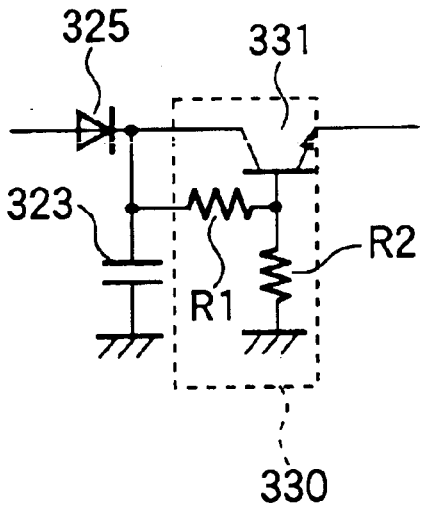
FIG. 10 is a partial circuit diagram showing a first modification of a constant-voltage circuit of the charger in the head driving apparatus shown in FIG. 7.
Figure 11:
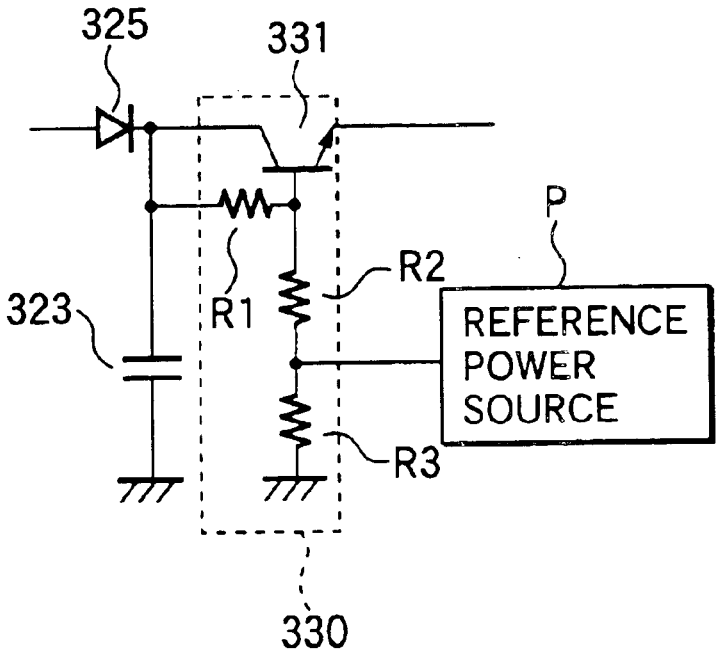
FIG. 11 is a partial circuit diagram showing a second modification of the constant-voltage circuit of the charger in the head driving apparatus shown in FIG. 7.

In this embodiment, though the constant-voltage circuit 330 uses the constant-voltage diode 332, the invention is not limited to this. For example, as shown in FIG. 10, the constant-voltage circuit 330 can use resistances R1 and R2, or it can use resistances R1, R2, R3 and a reference power source P as shown in FIG. 11. Therefore, the various well-known constant-voltage circuits can be used.

FIG. 12 shows the configuration of a head driving apparatus according to a fourth embodiment of the invention. A head driving apparatus 400 comprises piezoelectric elements 411 respectively provided correspondingly to plural nozzles of the ink jet printer; a head driver 412 for supplying a drive signal to a drive electrode 411*a* of each piezoelectric element 411; a current amplifier 413 and a switcher 414 that are provided between this head driver 412 and each piezoelectric element 411; and a bias power source 417 that applies a predetermined bias voltage to a common electrode 411*b* of the piezoelectric element 411.

Since the piezoelectric element 411, the head driver 412, the current amplifier 413 and the switcher 414 are the same as the piezoelectric element 211, the head driver 212, the current amplifier 213 and the switcher 214 in the head driving apparatus 200 shown in FIG. 5, their detailed description is omitted.

The bias voltage circuit 417 comprises a first condenser 420 that applies the predetermined voltage to the common electrode 411*b* of the piezoelectric element 411; and a charger 421.

In the condenser 420, one end is connected to the common electrode 411*b* of the piezoelectric element 411 so as to apply its charged voltage, that is, an intermediate potential Vc, to the electrode 411*b* of each piezoelectric element 411, and the other end is grounded.

The capacity of the first condenser 420 is set be sufficiently greater than the total electrostatic capacity (about several $\mu$F) of all the piezoelectric elements 411, for example, about several 100 $\mu$F to 1000 $\mu$F so that the stable bias voltage can be supplied to each piezoelectric element 411.

The charger 421 comprises a switcher 422 and a charge controller 423. The switcher 422 comprises a switching element 422*a* such as a transistor, an FET, a thyristor, or a triac. The charge controller 423, on the basis of a drive signal COM from the head driver 412, activates the switcher 422 at timings at which the drive signal COM is not used for ink ejection, as shown in FIGS. 13A and 13B, for example, when the potential of the drive signal COM is the intermediate potential Vc. Further, the charge controller 423 activates the switcher 422 at the print starting time thereby to increase gradually the voltage of the condenser 420 up to the intermediate potential Vc.

The head driving apparatus 400 is operated as described below. Firstly, the operation of driven piezoelectric element 411 for printing will be described. At the time T1 at which the printing is started, the switcher 422 is activated by the charge controller 423, so that the potential of the drive signal COM generated from the head driver 412 increases up to the intermediate potential Vc as shown in FIG. 14A.

Hereby, the electric current, on the basis of the drive signal COM, flows from the first transistor 415 of the current amplifier 413 through the switcher 414 to the drive electrode 411*a* of each piezoelectric element 411. Thereby the electrodes 411*a* is charged such that the potential thereof increases up to the intermediate potential Vc as shown by a solid line in FIG. 14B.

At this time, the charge controller 423 turns on the switching element 422*a* of the switcher 422, whereby the condenser 420 is charged by the drive signal COM. Hereby, since the charging voltage of the condenser 420 increases up to the intermediate potential Vc, as shown by a dashed line in FIG. 14B, the potential of the electrode 411*b* of the piezoelectric element 411 also increases gradually, and comes to the intermediate potential Vc.

Figures 14A, 14B:
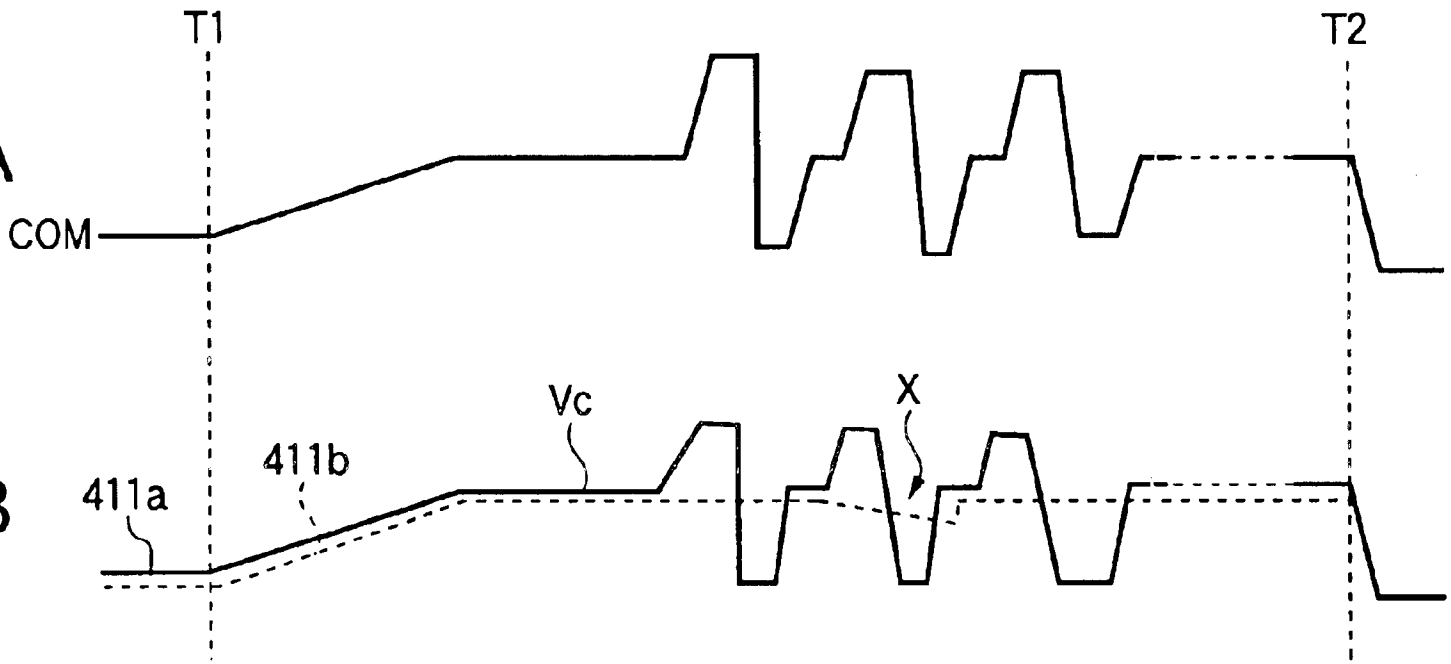
FIGS. 14A and 14B are time charts respectively showing a drive signal and potentials of both electrodes of a piezoelectric element in the head driving apparatus shown in FIG. 12.

Since the potential of the electrode 411*b* of the piezoelectric element 411 comes to the intermediate potential Vc similarly to the drive signal COM as shown in FIG. 14B, the potential difference between the both electrodes 411*a* and 411*b* of the piezoelectric element 411 is kept small. Consequently, since this potential difference is lower than the intermediate potential Vc of the drive signal COM, the piezoelectric element 411 does eject the ink droplet erroneously.

During the printing operation, on the basis of the variation of the drive signal COM, charging is performed to the drive electrode 411*a* through the first transistor 415, and discharging is performed from the drive electrode 411*a* through the second transistor 416 when the potential of the drive signal COM is lower than the intermediate potential Vc. Hereby, the piezoelectric element 411 operates on the basis of the drive signal COM thereby to eject the ink droplet.

On the other hand, the condenser 420, as described before, receives the intermediate potential Vc of the drive signal COM by activation of the switcher 422 and is charged, whereby its potential is held at the intermediate potential Vc. Hereby, the common electrode 411*b* of each piezoelectric element 411 receives the intermediate potential Vc from the condenser 420 and its potential is held at the intermediate potential Vc. Consequently, the potential difference between the both electrodes 411*a* and 411*b* of each piezoelectric element 411 becomes nearly zero.

When the printing is finished (T2), as shown in FIG. 14B, the potential of the drive electrode 411*a* of the driven piezoelectric element 411 is lowered to zero while discharging through the second transistor 416 of the current amplifier 413 in accordance with the drive signal COM.

On the other hand, the potential of the drive electrode 411*a* of the non-driven piezoelectric element 411 is still charged and held in the intermediate voltage Vc due to the activation of the switcher 422.

Since the potential of the electrode 411*b* of each piezoelectric element 411 is thus held at the intermediate potential Vc by the charging voltage of the condenser 420, the potential difference between the both electrodes 411*a* and 411*b* of the piezoelectric element 411 is kept nearly zero. Further, in a case that the driven piezoelectric element 411 and the non-driven piezoelectric element 411 are adjacent to each other, the voltage difference between the electrodes 411*a* of these piezoelectric elements 411 is also kept nearly zero.

Further, since the condenser 420 is charged using the intermediate potential Vc of the drive signal COM from the head driver 412, a power source such as a logic power source for generating the intermediate potential Vc is not particularly required.

In this embodiment, the charger 421 comprises the switcher 422 and the charge controller 423, however, another charger having the arbitrary configuration may be used as long as only the intermediate potential Vc of the drive signal COM can be supplied to the condenser 420 at the timings when the drive signal COM is not used for the ink ejection.

Figure 15:
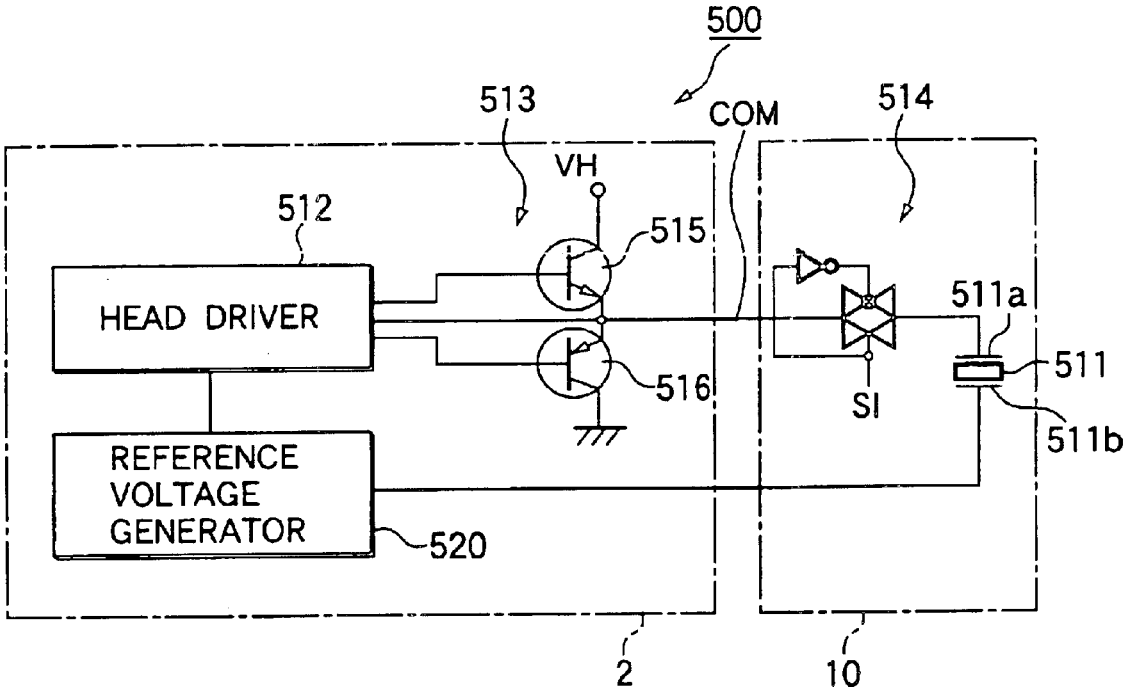
FIG. 15 is a block diagram showing the configuration of a head driving apparatus according to a fifth embodiment of the invention.

FIG. 15 shows the configuration of a head driving apparatus according to a fifth embodiment of the invention. A head driving apparatus 500 comprises: piezoelectric elements 511 respectively provided correspondingly to plural nozzles of the ink jet printer; a head driver 512 (drive waveform generator) for supplying a drive signal to a drive electrode 511*a* of each piezoelectric element 511; a current amplifier 513 and a switcher 514 that are provided between this head driver 512 and each piezoelectric element 511; and a reference voltage generator 520 that applies a predetermined bias voltage to a common electrode 511*b* of the piezoelectric element 511.

Since the piezoelectric element 511, the head driver 512, the current amplifier 513 and the switcher 514 are the same as the piezoelectric element 211, the head driver 212, the current amplifier 213 and the switcher 214 in the head driving apparatus 200 shown in FIG. 5, their detailed description is omitted.

The head driver 512 and the reference voltage generator 520 of these components are provided for a printer body 2, and the piezoelectric element 511 and the switcher 514 are provided for a print head 10.

The reference voltage generator 520 is so constituted as to apply the predetermined voltage to the common electrode 511*b* of the piezoelectric element 511. Here, this predetermined voltage can be set to a voltage nearly equal to an intermediate potential Vc of a drive signal COM supplied to the piezoelectric element 511. An example of such the configurational will be described with reference to FIG. 16.

Figure 16:
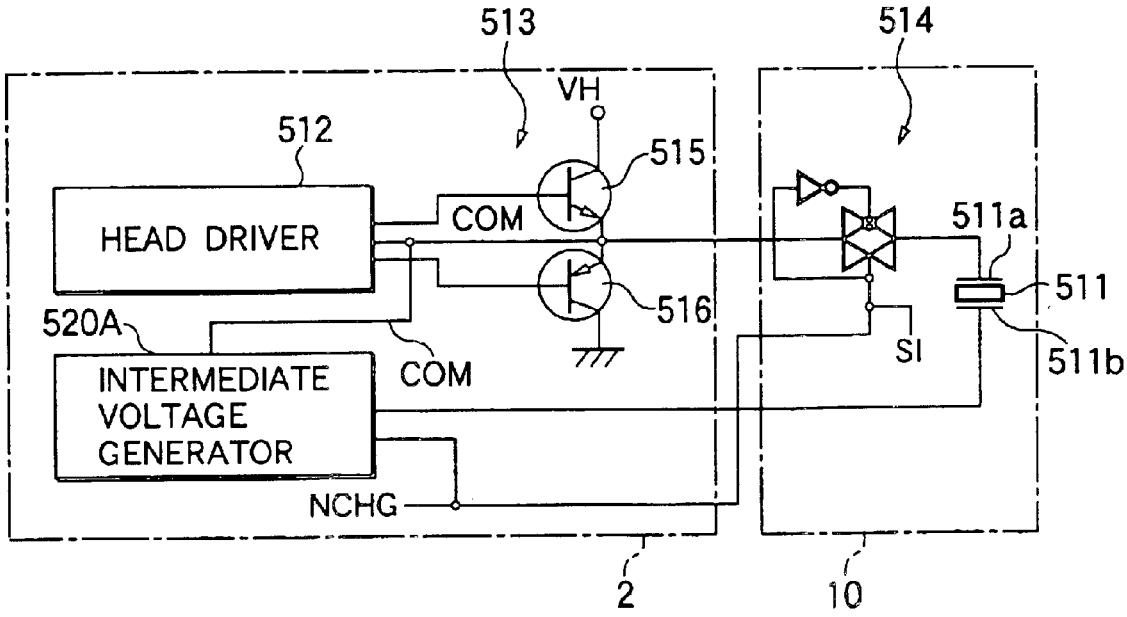
FIG. 16 is a detailed block diagram showing a reference voltage generator in the head driving apparatus shown in FIG. 15.

In the example shown in FIG. 16, the reference voltage generator 520 is constituted as an intermediate voltage generator 520A, and the output side of this intermediate voltage generator 520A is connected to the common electrode 511*b* of the piezoelectric element 511. Further, the input side of this intermediate voltage generator 520A is connected to the output side of the head driver 512, so that the drive signal COM is input from the head driver 512.

Figure 17:
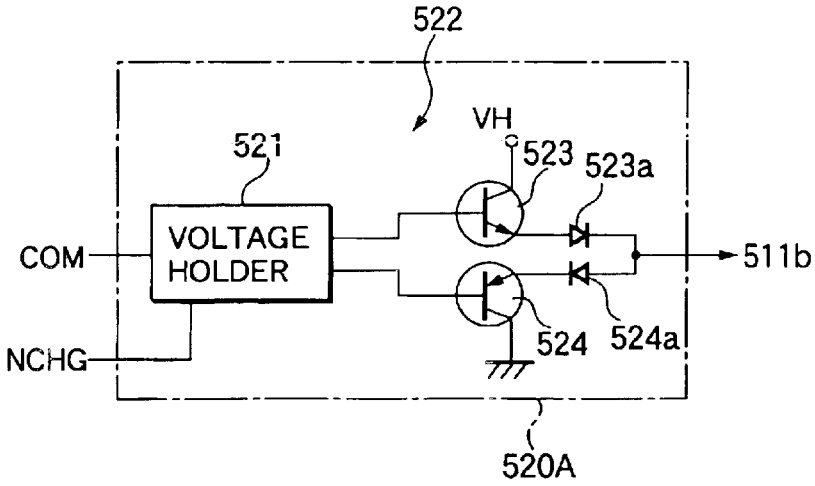
FIG. 17 is a detailed block diagram showing an intermediate voltage generator shown in FIG. 16.

Here, the intermediate voltage generator 520A, as shown in FIG. 17, specifically comprises a voltage holder 521 and a current amplifier 522.

The voltage holder 521 is charged by the drive signal COM from the head driver 512 at timing at which the piezoelectric element 511 is charged on the basis of a charge signal NCHG for the piezoelectric element 511. The current amplifier 522 comprises two transistors 523 and 524.

In a third transistor 523, a collector is connected to a constant-voltage power source (not shown), a base is connected to the output of the voltage holder 521, and an emitter is electrically connected to the common electrode 511*b* of the piezoelectric element 511 through a diode 523*a* in the forward direction. Hereby, the conduction of the third transistor 523 is established on the basis of the signal from the voltage holder 521, so that voltage VH is applied to the common electrode 511*b* of the piezoelectric element 511.

On the other hand, in a fourth transistor 524, an emitter is electrically connected to the common electrode 511*b* of the piezoelectric element 511 through a diode 524*a* in the reverse direction, a base is connected to the output of the voltage holder 521, and a collector is grounded. Hereby, the conduction of the transistor 524 is established on the basis of the signal from the voltage holder 521, so that the common electrode 511*b* of the piezoelectric element 511 is discharged.

Figure 18:
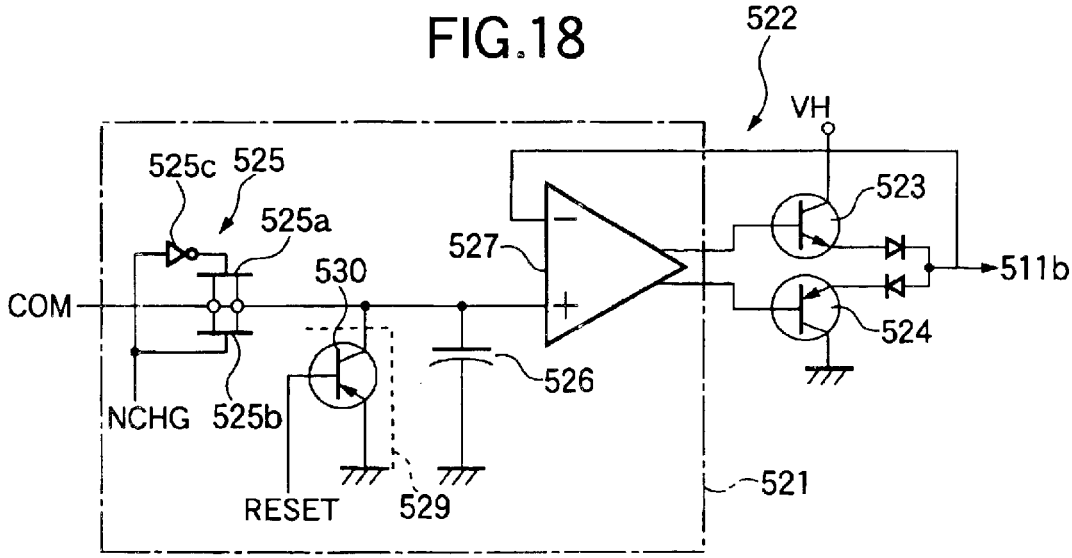
FIG. 18 is a detailed block diagram showing a voltage holder shown in FIG. 17.

FIG. 18 shows an example of the concrete configuration of the voltage holder 521. In FIG. 18, the voltage holder 521 comprises an analog switch 525, a charging condenser 526, a reset provider 529, and an analog amplifier 527.

The analog switch 525 has a well-known configuration, and comprises FETs 525*a*, 525*b* opposed and connected to each other, and an inverter 525*c*. To a gate electrode of one FET 525*a*, the charge signal NCHG is input through the inverter 525*c*, and to a gate electrode of the other FET 525*b*, it is directly input. Further, to source electrodes of the both FETs 525*a*, 525*b*, the drive signal COM is input from the head driver 512.

In the charging condenser 526, a drive electrode is connected to drain electrodes of the both FETs 525*a*, 525*b*, and a common electrode is grounded. Further, the capacity of the charging condenser 526 is suitably selected, correspondingly to self-discharge by input impedance of the analog amplifier 527 so as to become time constant that does not affect a period of the charge signal. Further, the reset provider 529 comprises a fifth transistor 530. A reset signal is input to a base of the fifth transistor 530, whereby conduction is established between a collector and an emitter and the residual voltage of the charging condenser 526 is discharged.

In the analog amplifier 527, to one input terminal a drive electrode of the charging condenser 526 is connected, and two output terminal are respectively connected to bases of two transistors 523 and 524 of the current amplifier 522. Further, to the other input terminal of the analog amplifier 527, output of the current amplifier 522 is feed-back input.

Here, the electric current from the constant-voltage power source of the current amplifier 522 is suitably selected so that in the time of charging the piezoelectric element, a peak of the electric current flowing through the first transistor 515 to the piezoelectric element 511 becomes the same as a peak of the electric current discharged from the piezoelectric element 511 through the fourth transistor 524, and so that in the time of discharging the piezoelectric element, a peak of the electric current discharged from the piezoelectric element 511 through the second transistor 516 becomes the same as a peak of the electric current flowing through the third transistor 523 to the piezoelectric element 511.

Therefore, it is not necessary to provide another power line. Consequently, in case that the head driving apparatus 500 is mounted on the print head, the number of the power lines is reduced. Further, in order to connect the head driving apparatus 500 and the printer body 2, the conventional FFC (Flexible Flat Cable) can be used.

The head driving apparatus 500 is operated as described below with reference to a timing chart in FIG. 19 and a flowchart in FIG. 20.

Figures 19A, 19B, 19C:
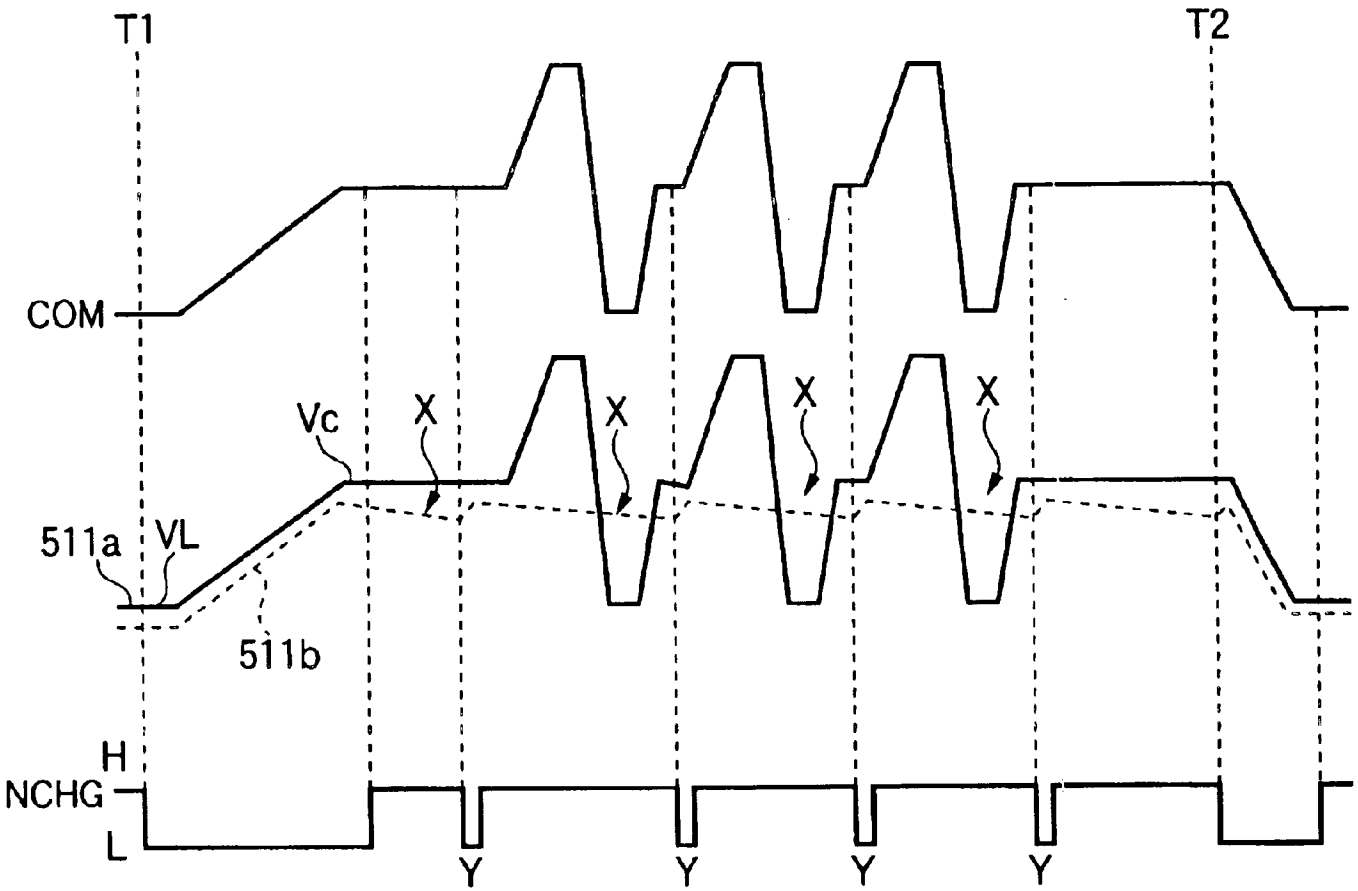
FIGS. 19A, 19B and 19C are time charts respectively showing a drive signal, potentials of both electrodes of a piezoelectric element, and a charge signal in the head driving apparatus shown in FIG. 15.
Figure 20:
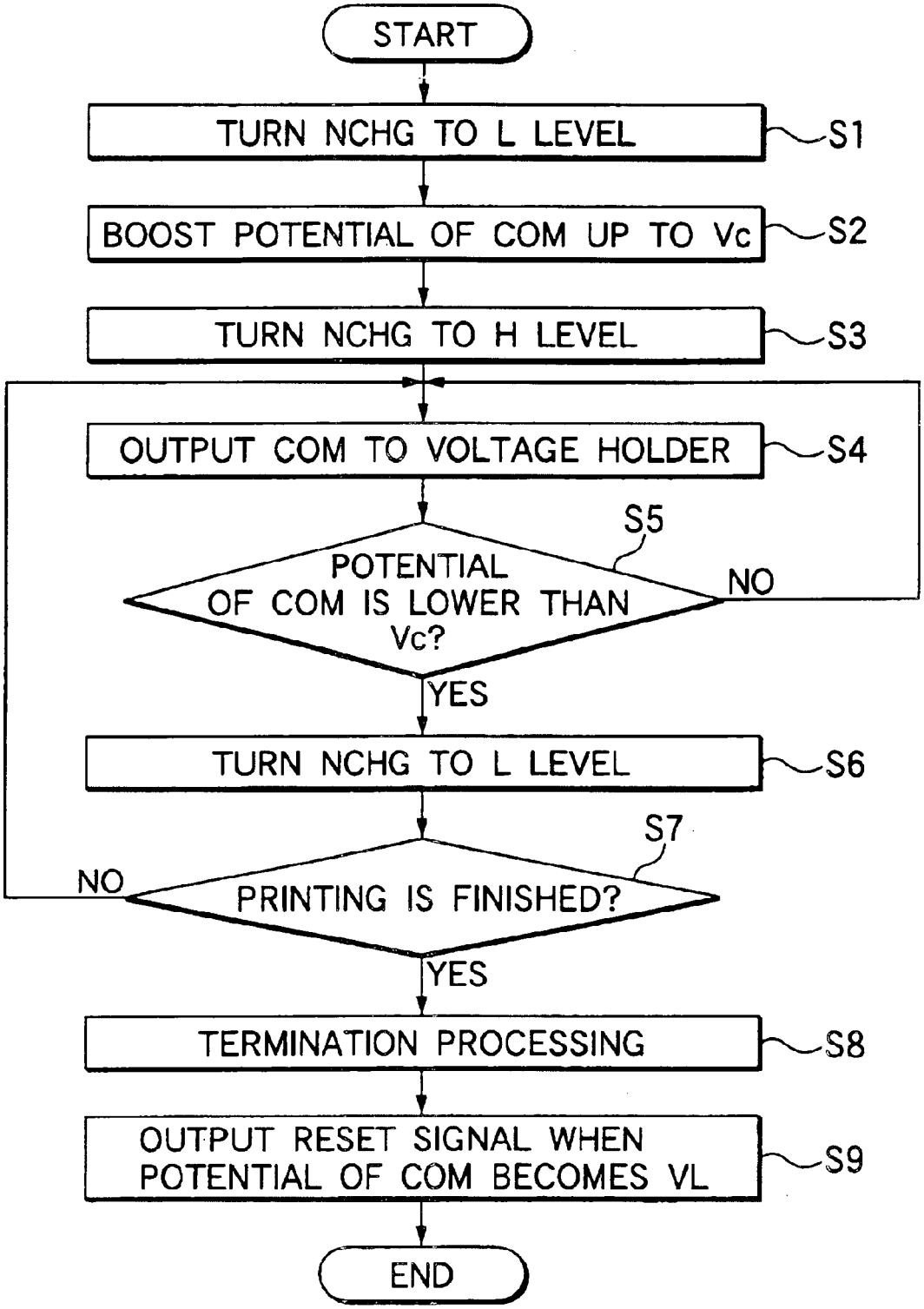
FIG. 20 is a flowchart for explaining the operation the head driving apparatus shown in FIG. 15.

At the time T1 at which the printing is started, a charge signal NCHG is turned to L level for a predetermined time period (e.g., 100 μs) as shown in FIG. 19C (step S1 in FIG. 20), so that the potential of the drive signal COM generated from the head driver 512 increases up to the intermediate potential Vc as shown in FIG. 19A (step S2 in FIG. 20).

Hereby, the electric current, on the basis of the drive signal COM, flows from the first transistor 515 of the current amplifier 513 through the switcher 514 to the drive electrode 511*a* of each piezoelectric element 511. Thereby the electrodes 511*a* is charged such that the potential thereof increases up to the intermediate potential Vc as shown by a solid line in FIG. 19B.

At this time, by the reversal of the charge signal NCHG, the charging condenser 526 in the voltage holder 521 is charged through the analog switch 525, whereby the arbitrary voltage of the drive signal COM is latched and output from the analog amplifier 527. Hereby, the conduction of the third condenser 523 in the current amplifier 522 is established, and the electric current flows from the constant-voltage power source (not shown) through the diode 523*a* to the common electrode 511*b* of the piezoelectric element 511. Hereby, as shown by a dashed line in FIG. 19B, the potential of the common electrode 511*b* of the piezoelectric element 511 also increases gradually and comes to the intermediate potential Vc (step S3 in FIG. 20).

Since the potential of the common electrode 511*b* of the piezoelectric element 511 comes to the intermediate potential Vc with the nearly same gradient as a gradient of the drive signal COM as shown in FIG. 19B, the potential difference between the both electrodes 511*a* and 511*b* of the piezoelectric element 511 is kept nearly zero. Consequently, the time which it takes for the potentials of the both electrodes 511*a* and 511*b* of the piezoelectric element 511 to come to the intermediate potential Vc at the start up time is not necessary to secure for a long while (e.g., 100 μs). Even in case that its time is set to, for example, 20 μs or 10 μs, the piezoelectric element 511 does not eject the ink droplet erroneously.

During the printing operation, the drive signal COM is output to the voltage holder 521 (step S4 in FIG. 20). On the basis of the variation of the drive signal COM, charging is performed to the drive electrode 511*a* through the first transistor 515, and discharging is performed from the drive electrode 211*a* through the second transistor 216 when the potential of the drive signal COM is lower than the intermediate potential Vc (No in step S5 in FIG. 20). Hereby, the piezoelectric element 211 operates on the basis of the drive signal COM thereby to eject the ink droplet.

Here, in order to prevent the piezoelectric element 511 from causing voltage drop due to self-discharge on the way as indicated by a reference character X in FIG. 19B, and prevent the potential of the electrode 511*a* from being lower than the intermediate potential Vc, the charge signal NCHG is turned to L level at a predetermined cycle associated with the drive signal COM, and a predetermined timing when the potential of the drive signal COM is not varied, as shown by a reference character Y in FIG. 19C.

Simultaneously, according to the L-level pulse of this charge signal NCHG, the predetermined voltage is applied to the common electrode 511*b* of each piezoelectric element 511 through the third transistor 523 of the current amplifier 522 in the reference voltage generator 520, whereby the common electrode 511*b* of the piezoelectric element 511 is charged and simultaneously its potential is held nearly at the intermediate potential Vc.

Hereby, even if the self-discharge of the charging condenser 526 occurs, on the basis of each pulse Y in L level of the charge signal NCHG, the both electrodes 511*a* and 511*b* of the piezoelectric element 511 are respectively charged, whereby their potentials can be held at the intermediate potential Vc. The operations in the above steps S4 to S6 are repeated till printing ends (No in step S7 of FIG. 20).

When the printing is finished (T2 in FIG. 19; and Yes in step S7 of FIG. 20), the predetermined terminating operation is performed (step S8 in FIG. 20). Namely, the potential of the drive electrode 511*a* of the driven piezoelectric element 511 is lowered to a low potential VL while discharging through the second transistor 516 of the current amplifier 513 in accordance with the drive signal COM. Simultaneously, the conduction of the fourth transistor 524 is established, and the common electrode 511*b* of the piezoelectric element 511 is discharged through the fourth transistor 524, so that the potential of the common electrode 511*b* becomes the low potential VL. Since the potential of the common electrode 511*b* of the piezoelectric element 511 comes to the low potential VL with the nearly same gradient as a gradient of the drive signal COM as shown in FIG. 19B, the potential difference between the both electrodes of the piezoelectric element 511 is kept nearly zero.

When the potential of the drive signal COM becomes the low potential VL, a reset signal is output to the reset provider 529 (step S9 in FIG. 20). Namely, the reset signal is input to the base of the fifth transistor 530 of the reset provider 529, whereby conduction is established between the collector and the emitter of the fifth transistor 530, so that the residual voltage of the charging condenser 526 is discharged. Hereby, a sequence of the head driving method according to this embodiment ends.

Thus, the output of the reference voltage generator 520, that is, the potential of the common electrode 511*b* of the piezoelectric element 511 is held nearly at the intermediate potential Vc in conformity with the drive signal COM from the head driver 512 during the printing is performed (except for the drive signal COM is used for the ink ejection). Therefore, the potential difference between the both electrodes 511*a* and 511*b* of the piezoelectric element 511 is kept nearly zero.

Consequently, even if the time which it takes for the potential of the piezoelectric element 511 to increase up to the intermediate potential Vc at the print starting time is reduced, and it becomes shorter than the conventional time 100 $\mu$s, the time period required for one printing operation can be shortened while preventing the erroneous operation of the piezoelectric element.

Further, since the reference voltage generator 520 performs charging and discharging of the common electrode 511*b* of the piezoelectric element 511, the conventional power source for holding the potential of the piezoelectric element at the intermediate potential is not necessary.

Further, since the voltage holder 521 of the reference voltage generator 520 operates on the basis of the drive signal COM from the head driver 512, adjustment is facilitated.

Further, since the potential of the common electrode 511*b* of the piezoelectric element 511 is always held nearly at the intermediate potential Vc, the potential difference between the both electrodes 511*a* and 511*b* of the piezoelectric element 511 is kept small.

Consequently, not only the consumed power in the piezoelectric element 511 is reduced, but also the voltage drop (power loss) due to the self-discharge of the piezoelectric element 511 is eliminated.

Even in a case that the driven piezoelectric element and the non-driven piezoelectric are adjacent to each other, the voltage difference between the electrodes 511*a* of these piezoelectric elements 511 is also kept small. Accordingly, since the discharging between the adjacent piezoelectric elements 511 are eliminated, it is not necessary to apply the insulation processing thereto even if the piezoelectric elements are crowdedly arranged.

Further, heat generation of the piezoelectric element is reduced, so that characteristic change of the piezoelectric element due to a change in temperature decreases. Further, even if operation characteristic of the piezoelectric element changes due to the temperature, since the reference voltage generator 520 holds always the potential of the piezoelectric element at the intermediate potential Vc, temperature correction is not required.

Further, as the piezoelectric element 111, 211, 311, an electrostrictive element or a magnetostrictive element may be used.

The invention can be applied to not only the ink jet printer as described above, but also to ink jet recording apparatuses such as a plotter and a facsimile. It can also be applied to an apparatus for jetting liquid of glue, manicure, etc., through each nozzle orifice and a manufacturing apparatus for coloring an optical filter.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A head driving apparatus, incorporated in an ink jet printer which comprises:

a print head, provided with a plurality of nozzles;

piezoelectric elements, each associated with one of the nozzles and provided with a drive electrode and a common electrode; and a head driver, which generates a drive signal for driving the piezoelectric elements, and selectively supplies the drive signal to at least one of the piezoelectric elements to eject an ink droplet from at least one associated nozzle, the head driving apparatus comprising: a bias power source, which applies a bias voltage having a predetermined potential to the common electrode of each piezoelectric element.

2. The head driving apparatus as set forth in claim 1, wherein the potential of the bias voltage is variable.

3. The head driving apparatus as set forth in claim 1, wherein the bias power source is provided as a logic power source.

4. The head driving apparatus as set forth in claim 1, wherein the bias power source generates the bias voltage based on a power supplied from a power source for driving the print head.

5. The head driving apparatus as set forth in claim 4, wherein the bias power source includes: a condenser, electrically connected to the common electrode; and a constant-voltage circuit, which applies the bias voltage to the condenser.

6. The head driving apparatus as set forth in claim 5, wherein:

the constant-voltage circuit includes a Zener diode, a current limiting resistance and a coupling element;

the Zener diode is electrically connected to the head driving power source through the current limiting resistance; and the Zener diode is electrically connected to the common electrode through the coupling element.

7. The head driving apparatus as set forth in claim 6, wherein the constant-voltage circuit includes a discharging diode electrically connected to the head driving power source in parallel with the current limiting resistance, such that a current is flowed to the head driving power source through the discharging diode.

8. The head driving apparatus as set forth in claim 1, wherein the bias power source includes:

a first condenser, electrically connected to the common electrode; and a charger, which charges the first condenser with electric charges discharged from the piezoelectric elements.

9. The head driving apparatus as set forth in claim 8, wherein the charger includes a second condenser charged with the electric charges.

10. The head driving apparatus as set forth in claim 9, wherein the charger includes a constant-voltage circuit which regulates a charged voltage of the second condenser, and applies the charged voltage to the first condenser.

11. The head driving apparatus as set forth in claim 9, wherein the second condenser is charged before a printing operation is performed.

12. The head driving apparatus as set forth in claim 1, wherein: the bias power source includes:

a condenser, which apply the bias voltage to the common electrode; and a charger, which charges the condenser based on a power supplied from a power source for driving the print head; and the bias voltage is substantially identical with an intermediate potential of the drive signal.

13. The head driving apparatus as set forth in claim 12, wherein the charger includes a switcher, which applies the intermediate potential to the condenser when the drive signal is not used for ejecting the ink drop.

14. The head driving apparatus as set forth in claim 13, wherein the switcher is provided as a switching element.

15. The head driving apparatus as set forth in claim 13, wherein the switcher is controlled in accordance with the drive signal.

16. The head driving apparatus as set forth in claim 1, wherein the bias power source is provided as a reference voltage generator which applies a reference voltage having a potential which is substantially identical with an intermediate potential of the drive signal, to the common electrode.

17. The head driving apparatus as set forth in claim 16, further comprising a charger which generates a charge signal for charging at least one of the piezoelectric elements when the drive signal is not used for ejecting the ink drop, wherein the reference voltage generator includes:

a voltage holder, which latches an arbitrary potential of the drive signal based on the charge signal; and an current amplifier, which current-amplifies a voltage output from the voltage holder.

18. The head driving apparatus as set forth in claim 17, wherein the reference voltage is applied when the charger charges the at least one of the piezoelectric elements, based on the output voltage of the voltage holder.

19. The head driving apparatus as set forth in claim 16, wherein: the reference voltage generator discharges at least one of the piezoelectric elements when a potential of the drive signal is higher than the intermediate potential while a printing operation is performed; and the reference voltage generator charges at least one of the piezoelectric elements when the potential of the drive signal is lower than the intermediate potential while the printing operation is performed.

20. The head driving apparatus as set forth in claim 19, wherein the reference voltage generator includes a discharger which discharges at least one of the piezoelectric elements.

21. A liquid jetting apparatus, comprising:

a jetting head, provided with a plurality of nozzles;

piezoelectric elements, each associated with one of the nozzles and provided with a drive electrode and a common electrode; and a head driving apparatus comprising a bias power source, which applies a bias voltage having a predetermined potential to the common electrode of each piezoelectric element.

22. A method of driving a jetting head in a liquid jetting apparatus, comprising the steps of:

providing a liquid jetting apparatus which comprises:

a jetting head, provided with a plurality of nozzles;

piezoelectric elements, each associated with one of the nozzles and provided with a drive electrode and a common electrode; and a head driver, which generates a drive signal for driving the piezoelectric elements, and selectively supplies the drive signal to at least one of the piezoelectric elements to eject an ink droplet from at least one associated nozzle;

providing a bias power source in the liquid jetting apparatus; and applying a bias voltage having a predetermined potential from the bias power source to the common electrode of each piezoelectric element.

23. The head driving method as set forth in claim 22, further comprising the step of charging at least one of piezoelectric elements when the drive signal is not used for ejecting the ink drop.

24. The head driving method as set forth in claim 22, further comprising the steps of:

determining a reference potential in the drive signal;

discharging at least one of the piezoelectric elements when a potential of the drive signal is higher than the reference potential while a printing operation is performed; and charging at least one of the piezoelectric elements when the potential of the drive signal is lower than the reference potential while the printing operation is performed.

25. The head driving method as set forth in claim 22, further comprising the step of varying a potential of the bias voltage so as to follow a potential of the drive signal when the drive signal is not used for ejecting the ink drops.

26. The driving method as set forth in claim 22, further comprising the steps of:

determining a reference potential as an intermediate potential of the drive signal; and adjusting the bias voltage based on the reference potential.

27. An ink-jet printer driving apparatus comprising:

a print head comprising a plurality of nozzles;

a plurality of piezoelectric elements, each associated with a respective one of the nozzles and comprising a drive electrode and a common electrode; and a head driver operable to generate a drive signal for driving the piezoelectric elements, and selectively supply the drive signal to at least one of the piezoelectric elements to eject an ink droplet from at least one associated nozzle, the head driving apparatus comprising a bias power source operable to apply a constant bias voltage to the common electrode of each piezoelectric element.

28. An ink-jet printer driving apparatus comprising:

a print head comprising a plurality of nozzles;

a plurality of piezoelectric elements, each associated with a respective one of the nozzles and comprising a drive electrode and a common electrode; and a head driver operable to generate a drive signal for driving the piezoelectric elements, and selectively supply the drive signal to at least one of the piezoelectric elements to eject an ink droplet from at least one associated nozzle, the head driving apparatus comprising a bias power source connected directly to the common electrode of each piezoelectric element and operable to apply a bias voltage to the common electrode of each piezoelectric element.

29. A method of driving a jetting head in a liquid jetting apparatus, the method comprising:

providing a liquid jetting apparatus comprising:

a jetting head, provided with a plurality of nozzles;

a plurality of piezoelectric elements, each piezoelectric element associated with one of the nozzles and provided with a drive electrode and a common electrode; and a head driver, operable to generate a drive signal for driving the piezoelectric elements, and further operable to selectively supply the drive signal to at least one of the piezoelectric elements to eject an ink droplet from at least one associated nozzle;

providing a bias power source in the liquid jetting apparatus; and applying a constant bias voltage having a predetermined potential from the bias power source to the common electrode of each piezoelectric element.

* * * * *